US011053631B2

(12) United States Patent
Kim et al.

(10) Patent No.: US 11,053,631 B2
(45) Date of Patent: Jul. 6, 2021

(54) CLOTHES TREATMENT APPARATUS HAVING A HEAT PUMP MODULE

(71) Applicant: LG ELECTRONICS INC., Seoul (KR)

(72) Inventors: Myoungjong Kim, Seoul (KR); Seongwoo An, Seoul (KR); Sangho Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 12 days.

(21) Appl. No.: 16/115,784

(22) Filed: Aug. 29, 2018

(65) Prior Publication Data

US 2019/0017217 A1 Jan. 17, 2019

Related U.S. Application Data

(62) Division of application No. 15/391,976, filed on Dec. 28, 2016, now Pat. No. 10,619,288.

(30) Foreign Application Priority Data

Jan. 5, 2016 (KR) ..... 10-2016-0001185

(51) Int. Cl.

| | |
|---|---|
| ***D06F 58/20*** | (2006.01) |
| ***D06F 39/12*** | (2006.01) |
| ***D06F 25/00*** | (2006.01) |
| ***D06F 37/22*** | (2006.01) |
| ***D06F 39/04*** | (2006.01) |
| ***D06F 34/28*** | (2020.01) |

(52) U.S. Cl.

CPC ..... *D06F 58/206* (2013.01); *D06F 25/00* (2013.01); *D06F 34/28* (2020.02); *D06F 37/22* (2013.01); *D06F 39/04* (2013.01); *D06F 39/12* (2013.01); *D06F 58/20* (2013.01)

(58) Field of Classification Search

CPC ..... D06F 58/206; D06F 39/04

See application file for complete search history.

(56) References Cited

U.S. PATENT DOCUMENTS

| | | | | |
|---|---|---|---|---|
| 2,287,203 | A * | 6/1942 | Smith | F25B 31/023 417/312 |
| 2,509,614 | A | 5/1950 | Philipp | |
| 2005/0198851 | A1 | 9/2005 | Tomochika et al. | |
| 2008/0257145 | A1 | 10/2008 | Sprinkle et al. | |
| 2009/0173110 | A1 | 7/2009 | Park et al. | |

(Continued)

FOREIGN PATENT DOCUMENTS

| | | |
|---|---|---|
| CN | 101113565 | 1/2008 |
| CN | 101687134 | 3/2010 |

(Continued)

OTHER PUBLICATIONS

EP2883996A1 Machine Translation (Year: 2015).*

(Continued)

*Primary Examiner* — Spencer E Bell

(74) *Attorney, Agent, or Firm* — KED & Associates, LLP

(57) ABSTRACT

Provided is a garment processing apparatus for compactly optimizing the arrangement space of a heat pump system. A heat pump module is modularized by integrally mounting a compressor, a condenser, and an evaporator in an integrated housing and is disposed at an upper portion of a tub.

16 Claims, 14 Drawing Sheets

(56) References Cited

U.S. PATENT DOCUMENTS

| | | | | |
|---|---|---|---|---|
| 2014/0041400 | A1 | 2/2014 | Cavarretta | |
| 2014/0208609 | A1 | 7/2014 | Han et al. | |
| 2015/0345866 | A1 | 12/2015 | Yu et al. | |
| 2016/0084341 | A1 | 3/2016 | Baron | |
| 2017/0159220 | A1* | 6/2017 | Miao | D06F 58/24 |

FOREIGN PATENT DOCUMENTS

| | | | | |
|---|---|---|---|---|
| CN | 102108622 | | 6/2011 | |
| CN | 202100894 | | 1/2012 | |
| CN | 102686792 | | 9/2012 | |
| CN | 103031694 | | 4/2013 | |
| CN | 203202526 | | 9/2013 | |
| CN | 203375141 | | 1/2014 | |
| CN | 204114516 | | 1/2015 | |
| CN | 204176284 | | 2/2015 | |
| CN | 204201385 | | 3/2015 | |
| CN | 104727080 | | 6/2015 | |
| CN | 104919105 | | 9/2015 | |
| DE | 4041324 | | 6/1991 | |
| EP | 1 156 149 | | 11/2001 | |
| EP | 2 270 274 | | 1/2011 | |
| EP | 2281934 | | 2/2011 | |
| EP | 2 339 063 | | 6/2011 | |
| EP | 2 778 278 | | 9/2014 | |
| EP | 2883996 | A1 * | 6/2015 | D06F 58/20 |
| JP | S60132080 | | 7/1985 | |
| JP | 2006-230887 | | 9/2006 | |
| JP | 2006-314503 | | 11/2006 | |
| JP | 2009-279059 | | 12/2009 | |
| JP | 2010-064020 | | 3/2010 | |
| JP | 2012-024137 | | 2/2012 | |
| JP | 2012-095718 | | 5/2012 | |
| JP | 2013-052067 | | 3/2013 | |
| JP | 2013-170584 | | 9/2013 | |
| JP | 2015-054109 | | 3/2015 | |
| JP | 2015-084996 | | 5/2015 | |
| KR | 10-2006-0127370 | | 12/2006 | |
| KR | 10-0664282 | | 1/2007 | |
| KR | 10-2014-0147026 | | 12/2014 | |
| WO | WO 2007/126169 | | 11/2007 | |
| WO | WO-2016103081 | A1 * | 6/2016 | D06F 25/00 |

OTHER PUBLICATIONS

Japanese Office Action dated Apr. 2, 2019 issued in JP Application No. 2018-551730.

Chinese Office Action dated Sep. 27, 2019 issued in CN Application No. 201611187532.6.

Korean Search Report dated Feb. 20, 2017 issued in Application No. PCT/KR2016/012799.

European Search Report dated May 9, 2017 Issued an Application No. 16207470.2.

U.S. Office Action issued in U.S. Appl. No. 15/391,976 dated Oct. 4, 2018.

Chinese Office Action dated Aug. 10, 2018 issued in Application No. 201611187532.6 (English translation attached).

European Search Report dated Sep. 4, 2018 issued in Application No. 18170594.8.

U.S. Office Action dated Aug. 21, 2019 issued in U.S. Appl. No. 15/391,976.

United States Office Action dated Feb. 13, 2019 issued in co-pending related U.S. Appl. No. 15/391,976.

United States Office Action dated Jan. 7, 2020 issued in U.S. Appl. No. 16/115,825.

Japanese Office Action dated Dec. 3, 2019 issued in Application No. 2018-551730.

Japanese Office Action dated Jan. 19, 2021 issued in JP Application No. 2019-104919.

Japanese Office Action dated Jan. 19, 2021 issued in JP Application No. 2019-104920.

* cited by examiner

CLOTHES TREATMENT APPARATUS HAVING A HEAT PUMP MODULE

CROSS-REFERENCE TO RELATED APPLICATION(S)

This application is a Divisional of U.S. patent application Ser. No. 15/391,976 filed on Dec. 28, 2016, which claims priority under 35 U.S.C. § 119 to Korean Application No. 10-2016-0001185, filed in Korea, on Jan. 5, 2016, the contents of which is incorporated by reference herein in its entirety.

BACKGROUND

1. Field

Provided is a garment processing apparatus having a heat pump module that supplies hot air into a drum by using a heat pump and fastening members for the heat pump module.

2. Background

Garment processing apparatuses using a heat pump and fastening members for the same are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1A:
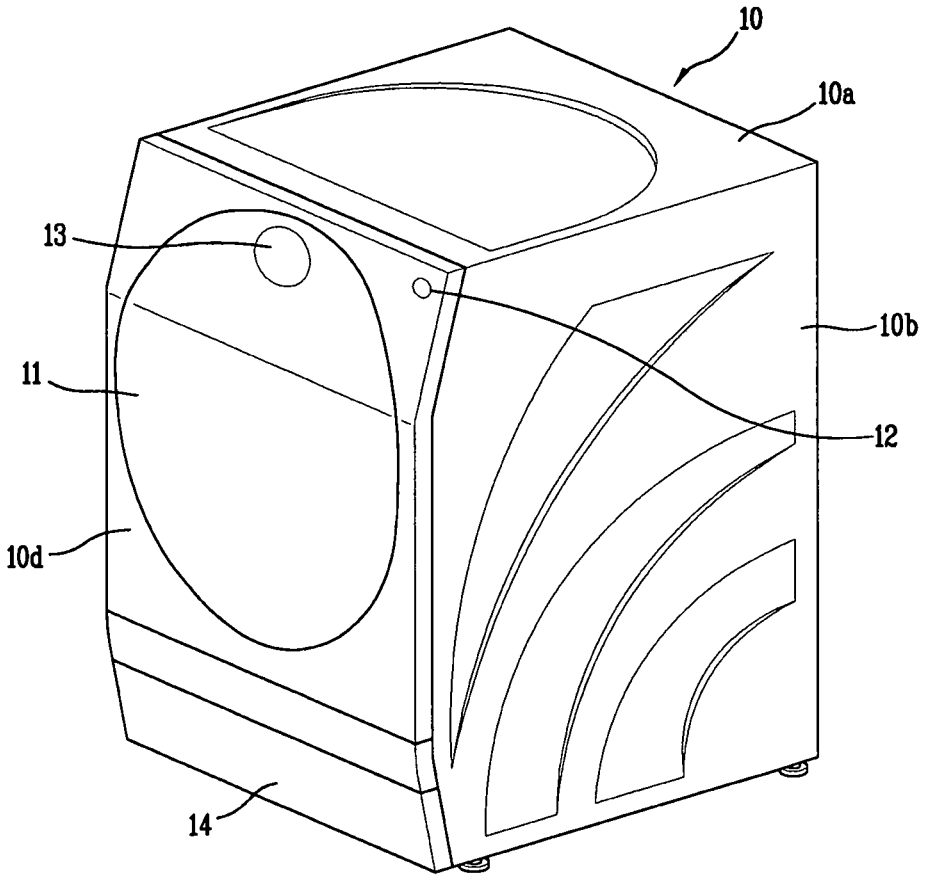
FIG. 1A is a perspective view illustrating a garment processing apparatus according to an embodiment.

Hereinafter, a garment processing apparatus including a heat pump module according to the present disclosure will be described in detail with reference to the accompanying drawings. In this specification, even in different embodiments, like reference numerals refer to like elements and the description thereof is replaced with the first description. The singular expressions include the plural expressions unless the context clearly dictates otherwise.

A garment processing apparatus generally refers to a washing machine that performs a function of washing clothes, a drying machine that performs a function of drying laundered clothes, or a washing and drying machine that performs both washing and drying functions. Moreover, in recent years, garment processing apparatuses have been developed which are equipped with a steam generating device having a refreshing function such as removing wrinkles of clothes, removing odors, removing static electricity, and the like or a sterilizing function.

Generally, a garment processing apparatus having a drying function includes a hot air supply unit for supplying hot air to laundry loaded in a garment receiving part such as a drum, thereby evaporating the moisture of the laundry and drying the laundry. Such a hot air supply unit may be classified into a gas type heater, an electric heater, and a heat pump system depending on a heat source for heating the air.

The heat pump system uses the refrigerant circulating through a compressor, a condenser, an expansion valve, and an evaporator to heat the air discharged from the drum, and then re-supplies hot air to the drum again. Since such a heat pump system is advantageous in energy efficiency compared with gas and electric heaters, development for applying a heat pump system as a hot air supply unit of a garment processing apparatus is actively underway.

Furthermore, a drum washing and drying machine among garment processing apparatuses includes a tub provided in a cabinet having, for example, a hexahedral shape and a drum rotatably installed in the tub. A cylindrical tub (or a drum) may have a large volume among internal components so that it occupies most of the internal space of the cabinet. For example, the outer circumferential part of the tub may be disposed close to the left and right side surfaces, the upper surface, or the lower surface of the cabinet.

In order to apply a heat pump system to a drum washing and drying machine, the heat pump system such as a compressor, a condenser, and an evaporator are installed in a space other than a space occupied by a tub (including a drum) in the space available in a cabinet, that is, a space between the side edges of a cabinet at the upper or lower space of the tub or at the upper (or lower) part of the tub.

In the case of a heat pump system in a conventional garment processing apparatus, a heat exchanger such as an evaporator and a condenser is disposed at the upper part of a tub, and a compressor is disposed at the lower part of a tub and the bottom surface of a cabinet. However, when the compressor is disposed at the lower part of the tub and the heat exchanger is disposed at the upper part of the tub and spaced from the compressor, there is a problem that it is very difficult to assemble the compressor and the heat exchanger because the installation space of the heat pump system is very narrow.

In addition, it may be possible to carry out a performance test of a heat pump system only in a state where the conventional garment processing apparatus is assembled as a finished product, and it may be impossible to carry out the performance test of the heat pump system alone when separated from the garment processing apparatus. Therefore, when a performance defect occurs in a state where a heat pump system is assembled with a garment processing apparatus as a finished product, for example when the temperature of the heat pump system does not rise or rises slowly due to refrigerant leakage or the like, it is difficult to see where refrigerant leakages occur when the heat pump system is assembled in the finished product. Moreover, even if a defective part is found, the heat pump system may require that it be disassembled to replace the defective part, reassembled, and re-inspected while assembled. Additionally, when a heat exchanger such as an evaporator and a condenser is separated from a compressor, the length of a refrigerant pipe connecting them becomes long, thereby causing energy loss.

Figure 9:
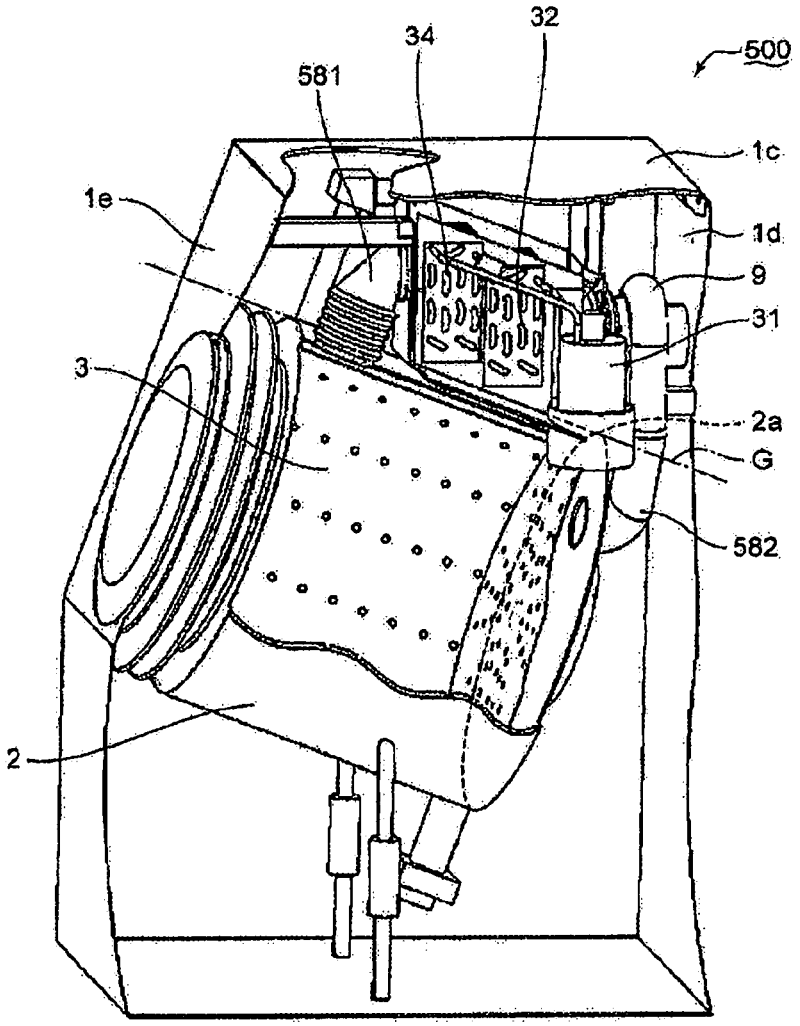
FIG. 9 is a sectional view illustrating a heat pump system disposed at the upper part of a tub in a drier.

Referring at the outset to FIG. 9, a heat pump system of a garment processing apparatus 500 may be disposed on a tub 2 in the dryer. However, the configuration as shown in FIG. 9 may also have various disadvantages.

A heat pump system 30 suctions the air discharged from the upper center of a tub 2 by a suction fan 9 and passes the suctioned air through an evaporator 34 and a condenser 32, and after exchanging heat with a refrigerant, re-supplies the air to a drum 3 again. A compressor 31 receives a gaseous refrigerant from the evaporator 34, compresses it to a high temperature and a high pressure, and supplies it to the condenser 32.

Since the tub 2 is disposed to be inclined downward toward the rear of a cabinet 1 at approximately 30 degrees, the rear space between the upper part of the tub 2 and a top cover 1*c* is relatively broad, so that sufficient amount of space exists for an upright type compressor 31 to be disposed long in a vertical direction. It is desirable to reduce a size of the cabinet, and hence, reduce the inclination angle of the tub 2.

However, if the inclination angle is less than 10 degrees or close to a horizontal direction, since the rear space between the upper part of the tub 2 and the top cover 1*c* becomes relatively narrow, an installation space is insufficient to place the upright type compressor.

Additionally, in the configuration of FIG. 9, two holes are formed respectively at the upper center surface and the rear surface of the tub 2, and through these holes the tub 2 and heat exchangers 32 and 34 are connected by ducts 581 and 582. However, the two holes formed at the tub 2 as shown in FIG. 9 may deteriorate the rigidity of the tub 2.

An improved garment processing apparatus that addresses these disadvantages is disclosed hereinafter.

FIG. 1A is a perspective view illustrating the appearance of a garment processing apparatus according to one embodiment of the present disclosure.

The garment processing apparatus may include a cabinet 10 forming the appearance and the outer shape. The cabinet 10 may have a hexahedral form and may be configured with a top cover 10*a* forming a hexahedral upper surface, a side cover 10*b* forming both side surfaces of a hexahedron, a base cover 10*c* forming a lower surface of a hexahedron, a front cover 10*d* forming a front surface of a hexahedron, and a back cover 10*e* forming a rear surface of a hexahedron.

A loading inlet for loading laundry may be formed at the front cover 10*d* and a circular door 11 for opening/closing the loading inlet is rotatably installed at the front cover 10*d*. One side of the door 11 may be coupled by a door hinge and the other side of the door 11 may rotate in the front and rear direction based on the door hinge. A press-type locking device may be provided at the other side of the door 11 and when the other side of the door 11 is pressed once, the door 11 is locked and when it is pressed again, the door 11 is unlocked.

A touch-type display unit 13 for user's operation may be provided at the upper end part of the door 11, so that it is possible to select and change an operation mode for performing washing, dewatering (draining) and drying cycles. Additionally, a power button 12 may be provided at the right upper end of the front cover 10*d* so that it is possible to turn on/off power during the washing, dewatering and drying cycles of the garment processing apparatus. A detergent supply unit may be installed at the lower part of the cabinet 10 to be drawable and insertable in a draw type. A lower cover 14 for covering the detergent supply unit may be rotatably installed in a vertical direction.

Figure 1B:
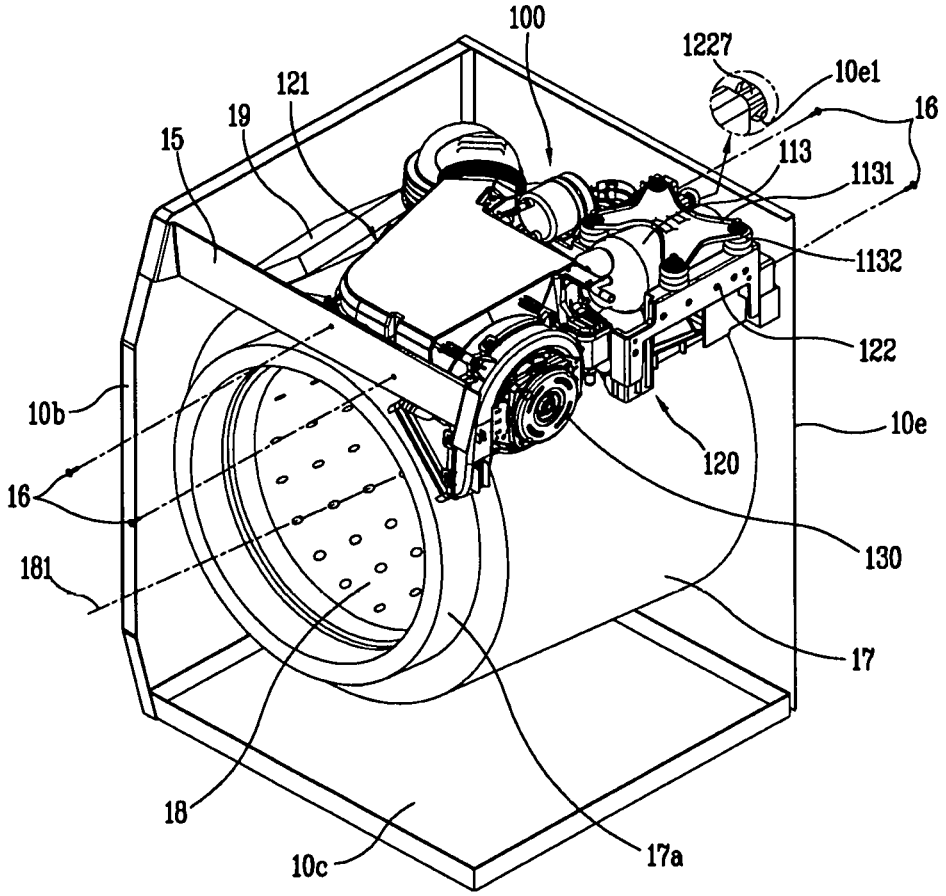
FIG. 1B is a perspective view of a heat pump module mounted in a cabinet of FIG. 1A.

FIG. 1B is a perspective view of a heat pump module mounted in a cabinet of FIG. 1A.

A cylindrical tub 17 disposed to be horizontal may be provided in the cabinet 10 for storing washing water therein. A loading inlet for loading laundry may be formed at the front area of the tub 17 to communicate with the loading inlet of the cabinet 10. A gasket 17*a* may be installed at the front end part of the tub 17 to prevent the washing water in the tub 17 from leaking into the cabinet 10.

A drum 18 may be rotatably provided in the tub 17. The drum 18 may include a laundry inlet opened toward the front cover 10*d* of the cabinet 10 and a reception space for washing and drying laundry therein. The drum 18 may receive power from a driving unit such as a motor to rotate. A plurality of holes may be formed at the outer circumference surface of the drum 18 to allow water or air to flow through the plurality of holes. A plurality of lifters may be disposed at the inner circumference surface of the drum 18 to be spaced in a circumference direction, so that the laundry loaded into the drum 18 may be tumbled.

A heat pump module 100 may be mounted at the upper part of the tub 17. The heat pump module 100 may integrally mount a compressor 113, a condenser 112, an expansion valve 114, and an evaporator 111 in the integrated housing 120 to modularize a heat hump system as one product.

The reason why the heat pump module 100 is disposed at the upper part of the tub 17 is to protect the heat pump module 100 from leaks. For example, in a washing machine where washing water stored inside of the tub 17, the water may leak to the lower part of the tub 17 due to sealing issues. Additionally, when the heat pump module 100 is installed or disassembled for maintenance, it is more advantageous that the heat pump module 100 is disposed at the upper part of the tub 17 than at the lower part of the tub 17.

In relation to the heat pump module 100, together with the heat exchanger 110 such as the evaporator 111 and the condenser 112, the compressor 113 may be integrally mounted in the integrated housing 120, so that a structure of a heat pump system may be simplified and also an arrangement space of a heat pump system may be compactly optimized.

Accordingly, in relation to the heat pump module 100, unlike the conventional compressor 113 disposed at the lower part of the tub 17 as separately spaced from the heat exchanger 110, in addition to the heat exchanger 110, the compressor 113 may be disposed in the integrated housing 120 disposed at the upper part of the tub 17, so that a structure of a pipe connecting the heat exchanger 110 and the compressor 113 becomes more simplified and the pipe length is shortened. Additionally, as a heat pump system is modularized, assembly and installation are made more simple and a performance test is possible only with the heat pump module 100 before the assembly of a finished product.

The integrated housing 120 may include a heat exchange duct part 121 for receiving and supporting the heat exchanger 110 and a compressor base part 122 for mounting the compressor 113. The heat exchange duct part 121 and the compressor base part 122 are formed as one body. For example, the heat exchange duct part 121 and the compressor base part 122 may be injection-molded integrally.

The heat exchange duct part 121 may be disposed at the upper front of the tub 17 and the compressor base part 122 may be disposed at the upper rear of the tub 17. One side (e.g., the left rear end part based on the front surface of the cabinet 10) of the heat exchange duct part 121 may be communicably connected to an air outlet at the upper rear of the tub 17, so that the air discharged from the drum 18 may flow into the heat exchange duct part 121. The other side (e.g., the right front end part based on the front surface of the cabinet 10) of the heat exchange duct part 121 may be communicably connected to an air inlet of the gasket 17*a* of the tub 17, so that the heated air heat-exchanged in the heat exchange duct part 121 may be re-supplied and circulated in the drum 18 again.

Based on the front surface of the cabinet 10, a suction fan 130 may be mounted at the right side surface of the heat exchange duct part 121. By providing circulation power to the air discharged from the drum 18, the suction fan 130 may allow the air discharged from the drum 18 to be circulated to the drum 18 again after allowing the air to pass through the evaporator 111 and the condenser 112.

Based on the front surface of the cabinet 10, the integrated housing 120 may further include a gas-liquid separator mounting part 123 (see, for example, FIG. 8A) at the rear of the heat exchange duct part 121 and the left side surface of the compressor base part 122. A gas-liquid separator 115 (see, for example, FIG. 2) may be fixed at the gas-liquid separator mounting part 123 when placed thereon. When a liquid refrigerant is included in the refrigerant discharged from the evaporator 111, the gas-liquid separator 115 may separate the liquid refrigerant from a gas refrigerant and delivers the gas refrigerant to the compressor 113.

The heat exchange duct part 121 may be forwardly supported by the front surface of the cabinet 10 and the compressor base part 122 may be backwardly supported by the rear surface of the cabinet 10.

A front frame 15 may be provided to connect the upper end inner walls at the front end parts of the side cover 10*b* disposed at both side surfaces of the cabinet 10 and the heat exchange duct part 121 may be fastened to and supported by the front frame 15 through a fastening member 16. At this point, two fastening members 16 may be disposed spaced from the front frame 15 in a diagonal direction and fastened to the front frame 15. Fastening members 16 may be a screw, bolt or another appropriate type of fastening structure. In the present disclosure, fastening member 16 will be referred to as a screw merely for convenience.

Additionally, the compressor base part 122 may be fastened to and supported by a back cover 10*e* through the screw 16. At this point, two screws 16 may be disposed spaced from the back cover 10*e* in a diagonal direction and fastened to the back cover 10*e*.

A control unit controls overall operations of the garment processing apparatus in addition to the heat pump module 100. The control unit may be configured including a PCB case 19 in a flat rectangular box shape having a lower height compared to the length and the width, a PCB built in the PCB case 19, and electrical/electronic control components mounted at the PCB.

Figure 1C:
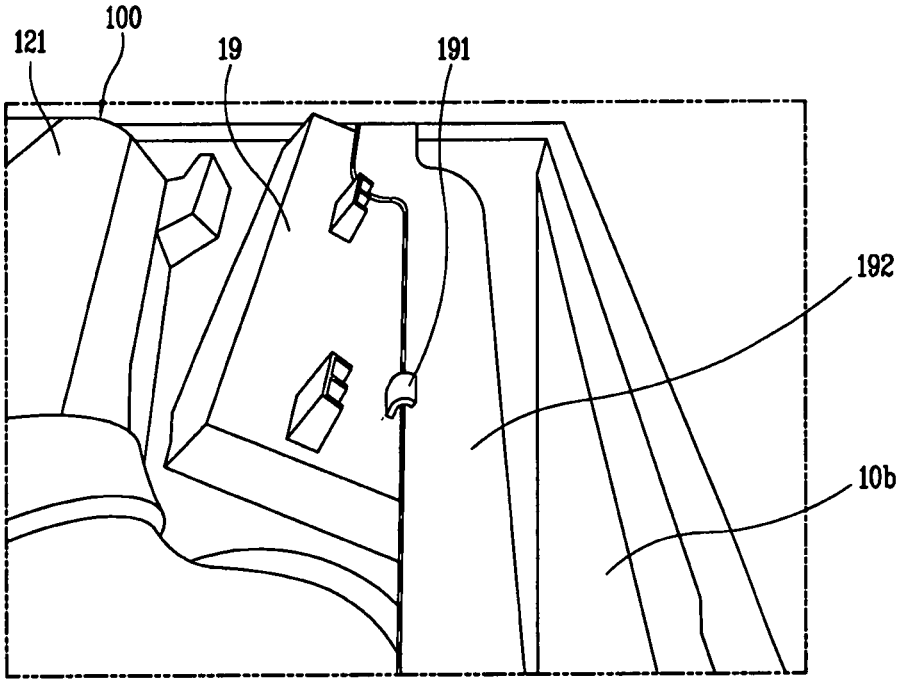
FIG. 1C is a rear perspective view illustrating a fixing structure of a PCB case shown in FIG. 1B.

FIG. 1C is a rear perspective view illustrating a fixing structure of a PCB case shown in FIG. 1B.

The PCB case 19 may be disposed at the left side surface of the heat pump module 100 in a diagonal direction (based on when seen from the front cover 10*d*) by using a space between the upper part of the tub 17 and the left side edge of the cabinet 10. In the case of the PCB case 19, compared to a space between the upper center of the tub 17 and the side cover 10*b* at the left, the width length of the PCB case 19 is long and, in order to avoid the interference with other components and compactly configure the PCB case 19 together with the heat pump module 100, it is desirable that the PCB case 19 is disposed from the center upper part of the cabinet 10 toward the left side in a downward direction when seen from the front cover 10*d*. This is because the left side surface of the heat pump module 100 is disposed between the center upper part of the cabinet 10 and the upper part of the tub 17, and a space from the left side edge of the cabinet 10 toward a downward direction is wider than a space between the center upper part of the cabinet 10 and the upper part of the tub 17. Hence, the right side surface of the PCB case 19 may be positioned to face the left side surface of the heat pump module 100 and the left side surface of the PCB case 19 may be disposed in a diagonal direction to face the left side cover 10*b* of the cabinet 10.

The PCB case 19 may include a fixing protrusion 191 protruding from one side of the upper surface to stably support the PCB case 19 in the cabinet 10. The upper end part of the fixing protrusion 191 may be formed in a hook shape. Additionally, in order to support the PCB case 19, the cabinet 10 may include a fixing member 192 extending lengthwise from the upper end part of the front cover 10*d* to the upper end part of the back cover 10*e*. As the upper end part of the fixing protrusion 191 is supported to be caught by the side surface of the fixing member 192, the PCB case 19 may be stably supported between the left side edge of the cabinet 10 and the heat pump module 100 and disposed in a compact manner.

The PCB case 19 is electrically connected to the heat pump module 100, so that the performance of the heat pump module 100 may be tested by a module unit before the finished product of the garment processing apparatus is assembled. In this case, since the PCB case 19 is connected to the heat pump module 100 to test the performance of the heat pump module 100, it is desirable that the PCB case 19 is disposed close to the heat pump module 100.

Accordingly, as the PCB case 19 is disposed close to and connected to the side surface of the heat pump module 100 in a diagonal direction, it may be installed in the cabinet 10 more compactly together with the heat pump module 100.

Figure 2:
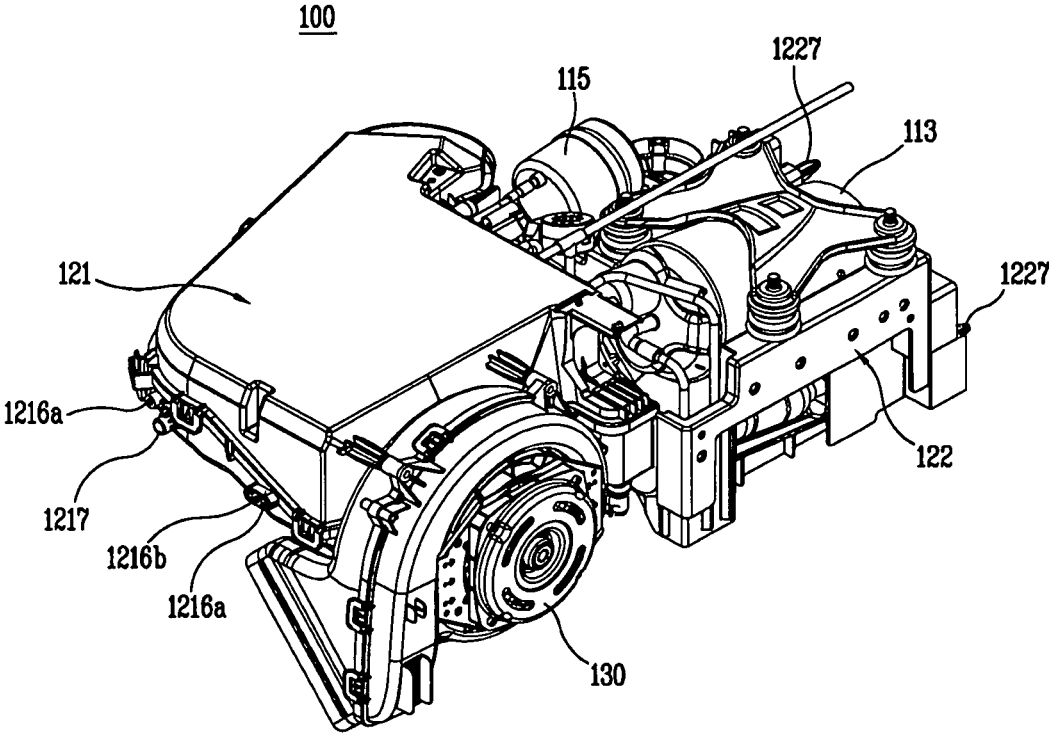
FIG. 2 is a perspective view of a heat pump module of FIG. 1.
Figure 3:
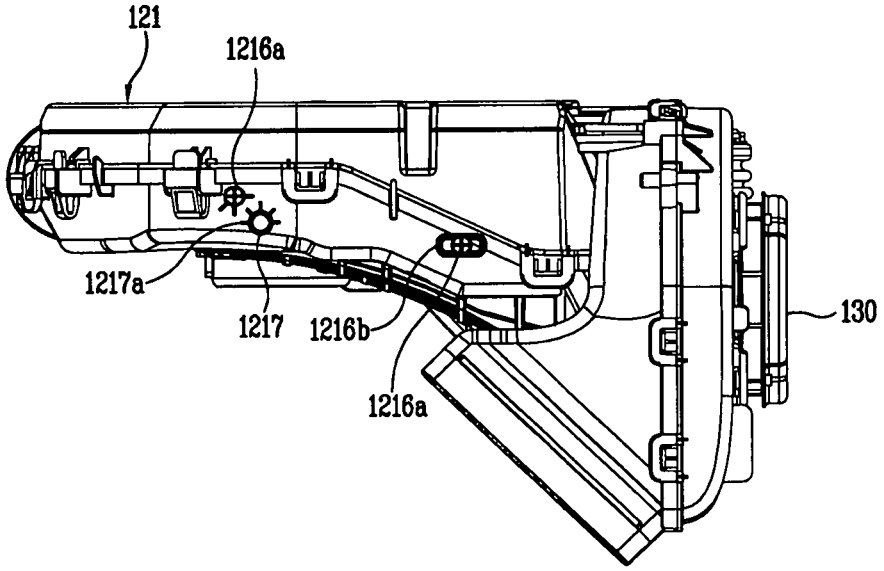
FIG. 3 is a front view of a heat pump module of FIG. 2 viewed from the front surface of a cabinet.
Figure 4:
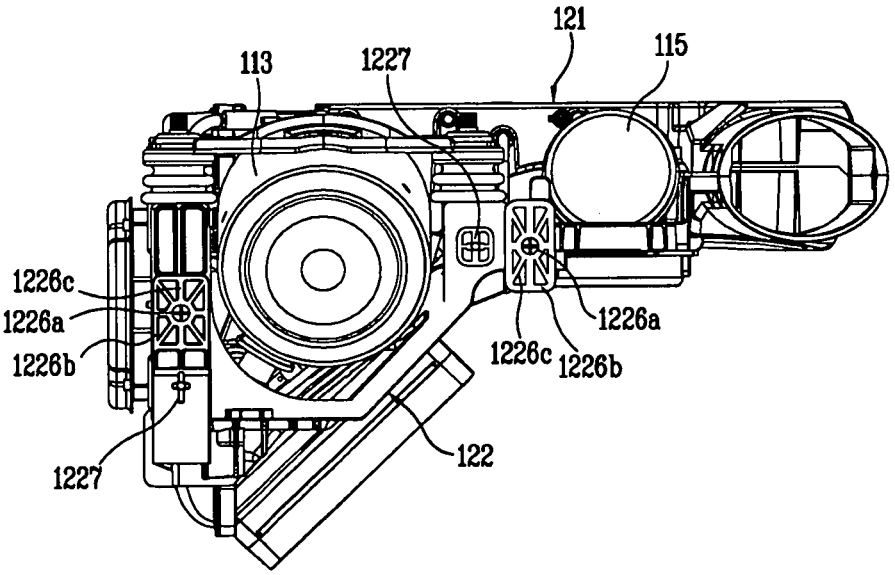
FIG. 4 is a rear view of a heat pump module of FIG. 2 viewed from the rear surface of a cabinet.

FIG. 2 is a perspective view illustrating a heat pump module of FIG. 1B. FIG. 3 is a front view illustrating a heat pump module of FIG. 2 when seen from the front surface of a cabinet. FIG. 4 is a back view illustrating a heat pump module of FIG. 2 when seen from the rear surface of a cabinet. As illustrated in FIG. 2, the compressor 113 mounted on the compressor base part 122 and the gas-liquid separator 115 may be mounted on the gas-liquid separator mounting part 123.

At least two fastening parts 1216*a* in a circular pipe form for fixing with the screw 16 may be provided at the front surface of the heat exchange duct part 121. A fastening groove may be formed in the fastening part 1216*a*. For example, one of the two fastening parts 1216*a* may further include an elliptical fastening part 1216*b*. The elliptical fastening part 1216*b* may be formed to surround the outer side surface of the circular fastening part 1216*a*. As the screw 16 is fastened to the two circular fastening parts 1216*a* by penetrating a front frame 15, the front surface of the integrated housing 120 may be supported by the front frame 15.

At least two fastening parts 1226*a* in a circular pipe form for fixing with the screw 16 may be provided at the rear surface of the compressor base part 122. As a fastening groove is formed in the fastening part 1226*a*, the screw 16 may be inserted and fastened to the fastening groove of the fastening part 1226*a*. Additionally, in order to reinforce the strength of the circular fastening part 1226*a*, a rectangular fastening part 1226*b* for receiving the two circular fastening parts 1226*a* therein may be further provided. A plurality of reinforcing ribs 1226*c* may be provided between the circular fastening part 1226*a* and the rectangular fastening part 1226*b*. The screw 16 may penetrate the back cover 10*e* to be fastened to the inside of the circular fastening part 1226*a*.

Accordingly, in relation to the integrated housing 120, the front surface of the heat exchange duct part 121 is supported by the front frame 15 at two points by screws 16 and the rear surface of the compressor base part 122 is supported by the back cover 10*e* at two points. Thus, it is possible to sufficiently support the load of the heat pump module 100.

In order to precisely match the assembling position of the screw 16 on the front surface of the heat exchange duct part 121 and the rear surface of the compressor base part 122, at least one protrusion part 1217 or protrusion part 1227 may be provided. For example, at least one protrusion part 1217 may protrude at the front surface of the heat exchange duct part 121 and two protrusion parts 1227 may protrude at the rear surface of the compressor base part 122. The protrusion part 1217 provided at the front surface of the heat exchange duct part 121 may include a plurality of protrusion ribs 1217*a* protruding at the outer circumference surface of a circular pipe. At this point, the protrusion rib 1217*a* has a height or size that is decreased gradually as it progressively goes to the end part of the protrusion part 1217, so that it is easy to insert the protrusion rib 1217*a* and the protrusion part 1217 into a guide hole 10*e*1. A cross-shaped protrusion part 1227 may be provided at the rear surface of the compressor base part 122.

Additionally, the guide hole 10*e*1 may be formed at each of the front frame 15 and the back cover 10*e* separately from a screw fixing part of the housing 120. When the protrusion part 1217 or the protrusion part 1227 is inserted into the guide hole 10*e*1 and fastened temporarily, it is easy to assemble the screw 16 without having to find the assembly position of the screw 16. Hence, the protrusion part 1217 or the protrusion part 1227 may serve to fix the assembly position of the screw 16 and also support the integrated housing 120.

Figure 5:
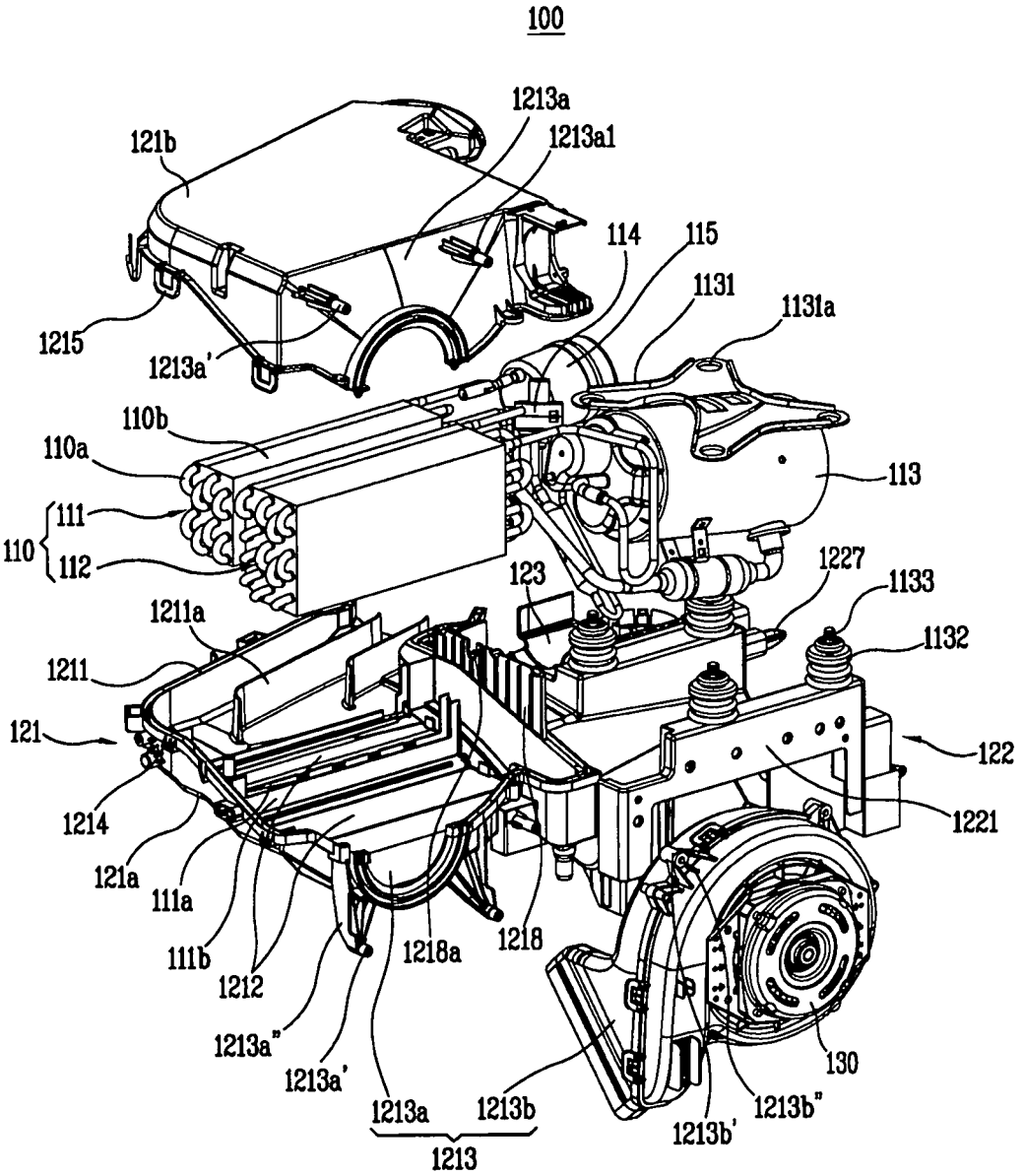
FIG. 5 is an exploded view of a heat pump module of FIG. 2.

FIG. 5 is an exploded view of a heat pump module of FIG. 2.

A heat exchange duct part 121 may be separated into a duct body 121*a* and a duct cover 121*b*. The duct cover 121*b* covers the upper part of the duct body 121*a*. The duct body 121*a* and the duct cover 121*b* may be coupled to each other to maintain airtightness. In order to fasten the duct body 121*a* and the duct cover 121*b*, a U-shaped fastening member 1215 may be provided to extend directly downward at the lower end of the rim part of the duct cover 121*b*. A plurality of U-shaped fastening members 1215 may be disposed spaced apart from each other along the rim part of the duct cover 121*b*. Additionally, a wedge-shaped fastening rib 1214 may protrude in a side direction at the rim part of the duct body 121*a*. Two or more fastening ribs 1214 may be disposed adjacent to each other at one place, so that three fastening ribs 1214 may be inserted and fastened to the inside of the U-shaped fastening member 1215. The fastening rib 1214 and the fastening member 1215 may be disposed to face and contact each other when the duct body 121*a* and the duct cover 121*b* are assembled. The coupling of the fastening rib 1214 and the fastening member 1215 is to insertingly fasten the wedge-shaped fastening rib 1214 to the hole inside of the fastening member 1215 as the duct cover 121*b* is pressed downwardly in a one-touch type.

The heat exchange duct part 121 may be divided into a heat exchanger mounting part 1212 and first and second connection ducts 1211 and 1213 according to each part function. That is, if the duct body 121*a* and the duct cover 121*b* are divided as two parts for receiving the heat exchanger 110 therein, the heat exchanger mounting part 1212 and the first and second connection ducts 1211 and 1213 may have a configuration divided according to each part function of a duct part.

The heat exchanger mounting part 1212 is configured to receive the evaporator 111 and the condenser 112 inside a duct part. The evaporator 111 and the condenser 112, as the heat exchanger 110 for exchanging heat with a refrigerant and air, may be configured including a refrigerant pipe 110*a* for providing a refrigerant flow passage to the evaporator 111 and the condenser 112 and a heat transfer plate 110*b* for extending a heat exchange area of the refrigerant pipe 110*a*. A plurality of heat transfer plates 110*b* may be spaced a predetermined interval (e.g., a narrow gap) from one another to allow air to pass through and the refrigerant pipe 110*a* may be coupled to penetrate and contact the heat transfer plate 110*b*.

The evaporator 111 may be disposed at the upstream side and the condenser 112 is disposed at the downstream side based on an air flowing direction. The air flowing direction is a direction intersecting a rotation center line 181 of a drum 18. The evaporator 111 and the condenser 112 are spaced apart from each other in a direction intersecting the rotation center line 181 of the drum 18.

The heat exchanger mounting part 1212 may include two condensed water scattering prevention bumps 111*a* and 111*b* protruding from the bottom surface between the evaporator 111 and the condenser 112. The condensed water scattering prevention bumps 111*a* and 111*b* may prevent the condensed water generated from the evaporator 111 from being scattered to the condenser 112 along with the movement of air. The two condensed water scattering prevention bumps 111*a* and 111*b* may be spaced apart from each other at an interval between the evaporator 111 and the condenser 112.

One condensed water scattering prevention bump 111*a* (adjacent to the air outlet side of the evaporator 111) includes a plurality of condensed water drain holes for allowing condensed water to flow from the bottom surface of the evaporator 111 to a condensed water drain space formed at the bottom between the condensed water scattering prevention bumps 111*a* and 111*b*. The other one condensed water scattering prevention bump 111*b* (adjacent to an air inlet side of the condenser 112) prevents condensed water to be scattered by the air flow at the bottom surface of the air outlet side of the evaporator 111 so that condensed water is not scattered and drops into a condensed water drain space. At this point, since the scattering of the condensed water generated from the evaporator 111 occurs mainly at the lower part of the evaporator 111 due to cohesive power, it is not critical that the condensed water scattering prevention bump 111*a* protrudes only to a predetermined height from the bottom surface of the heat exchanger mounting part 1212 to a vertical upward direction.

The heat exchanger mounting part 1212 may include a sealing plate 1218 for maintaining an airtight with the refrigerant pipe 110*a* of the evaporator 111 and the condenser 112. If the air passing through the evaporator 111 and the condenser 112 leaks to the outside of a heat exchange duct part, the heat exchange efficiency of the heat exchanger 110 drops, and hence, the internal air of the heat exchange duct part 121 is prevented from being leaked to the outside. The refrigerant pipe 110*a* of the evaporator 111 and the condenser 112 may penetrate from the inside of the heat exchange duct part 121 to the outside in order to connect to the compressor 113 and the expansion valve 114.

At this point, the sealing plate 1218 may be provided between the refrigerant pipe 110*a* penetrating the heat exchange duct part 121 and the heat exchange duct part 121 to maintain the airtightness. For this, a sealing groove 1218*a* that extends protruding from the rear side surface of the heat exchanger mounting part 1212 toward a vertical upward direction to allow the refrigerant pipe 110*a* to penetrate is formed at the sealing plate 1218. The refrigerant pipe 110*a* is seated and supported in the sealing groove 1218*a* and a sealing ring is inserted into the refrigerant pipe 110*a* to maintain the airtightness between the heat exchange duct part 121 and the refrigerant pipe 110*a*.

The first connection duct 1211 may extend from one side (e.g., the air inlet side of the evaporator 111) of the heat exchanger mounting part 1212 toward the upper rear of the tub 17 to be communicably connected to the air outlet of the tub 17 and the air discharged from the drum 18 passes through the evaporator 111 and the condenser 112 sequentially through the first connection duct 1211. The air outlet of the tub 17 may be formed rearwardly from the upper part of the tub 17 toward the back cover 10*e*. A plurality of air guides 1211*a* for guiding the flow of the air discharged from the air outlet of the tub 17 may be provided in the first connection duct 1211. The plurality of air guides 1211*a* may protrude lengthwise along the flow direction of air and may be spaced apart from the first connection duct 1211 in a lateral direction.

The second connection duct 1213 may be connected communicably from the other side (e.g., the air outlet side of the condenser 112) of the heat exchanger mounting part 1212 to the air inlet of the tub 17 and the air passing through the condenser 112 may be re-supplied to the drum 18 through the second connection duct 1213 and circulated. The air inlet of the tub 17 may be formed at the upper part of the gasket 17*a*.

A suction fan 130 may be provided at the second connection duct 1213. The suction fan 130 may be disposed at the downstream side of the condenser 112 and suctions the air discharged from the drum 18 to pass it through the heat exchanger 110, and then provides circulation power to the air to be circulated to the drum 18 again. The suction fan 130 is connected to a fan motor and receives rotation power from the fan motor to rotate.

The second connection duct 1213 may be configured to include a duct part connection duct 1213*a* extending from the heat exchanger mounting part 1212 to the right side cover 10*b* and a fan connection duct 1213*b* extending from the suction fan 130 to the air inlet (i.e., the air inlet of the gasket 17*a*) of the tub 17. The duct part connection duct 1213*a* and the fan connection duct 1213*b* may be communicably connected to each other. The duct part connection duct 1213*a* may have an air-flow sectional area that is narrower as it progressively extends from the air inlet of the condenser 112 toward the side cover 10*b*. The fan connection duct 1213*b* may receive the suction fan 130 therein, and may be configured to include two separable ducts to form a flow passage between the condenser 112 and the air inlet of the tub 17. That is, two fan connection ducts 1213*b* may be vertically disposed facing each other at the right side surface of the heat exchange duct part 121 and detachably coupled to each other. At this point, the U-shaped fastening member 1215 and the fastening rib 1214 are disposed to face each other in a side direction to be fastened to each rim part of the two fan connection ducts 1213*b*.

Additionally, in order to couple the duct part connection duct 1213*a* and the fan connection duct 1213*b*, fastening parts 1213*a*' and 1213*b*' in a pipe shape for bolt fastening may be provided respectively at the outer side surface of the duct part connection duct 1213*a* and the outer circumference surface of the fan connection duct 1213*b*. The fastening parts 1213*a*' and 1213*b*' in a pipe shape may contact each other when the duct part connection duct 1213*a* and the fan connection duct 1213*b* are assembled and may be fastened by the screw 16. At this time, in order to reinforce the strength of the fastening part 1213*a*', a reinforcing rib 1213*a*1 may be formed at the outer circumference surface of the fastening part 1213*a*'. Additionally, a connection rib 1213*a*" for connecting the fastening part 1213*a*' and the duct part connection duct 1213*a* and a connection rib 1213*b*" for connecting the fastening part 1213*a*' and the fan connection duct 1213*b* may be provided.

Here, in order to increase the heat exchange efficiency of the heat exchanger 110 while compactly optimizing the arrangement space of the heat pump system, the bottom surface of the integrated housing 120 may be formed to be rounded along the upper surface (e.g., a round portion formed as a circular shape) of the tub 17. The bottom surface of the integrated housing 120 and the upper surface of the tub 17 may be spaced apart from each other by a small interval or gap.

For example, the bottom surface of the duct part of the heat exchanger 110 may be formed to be rounded so that the height of the duct part of the heat exchanger 110 may gradually increase from the upper center of the tub 17 as it progressively goes toward the side cover 10*b*. That is, the height of the first connection duct 1211 is the smallest, and the height of the heat exchanger mounting part 1212 is further increased compared to the first connection duct 1211, and the heights of the second connection duct 1213 and the suction fan 130 are increased compared to the heat exchanger mounting part 1212.

This is to increase the heat exchange efficiency while maximizing the space between the upper surface of the cylindrical tub 17 and the flat top cover 10*a* because the space between the upper surface of the tub 17 and the top cover 10*a* gradually widens from the upper center of the tub 17 toward the side cover 10*b*.

Accordingly, in order to increase the heat exchange efficiency while maximizing the space between the upper of the tub 17 and the top cover 10*a*, the sizes of the heat exchanger 110 and the connection duct may be increased and an appropriate arrangement is required in consideration of the suction fan 130.

The first connection duct 1211 for suctioning air in the heat exchange duct part 121 may be configured to have a relatively small height in consideration of a narrow space between the upper center part of the tub 17 and the top cover 10*a*, and have the size of a sectional area that is increased as it progressively goes from the inlet of the first connection duct 1211 to the heat exchanger mounting part 1212.

In consideration of functional aspects, the heat exchanger mounting part 1212 may further increase the size of the condenser 112 for heating the air supplied to the drum 18 than the evaporator 111 for removing the moisture in air discharged from the drum 18. Since the size and height of the condenser 112 are greater than those of the evaporator 111, the heat exchange area of the condenser 112 is greater.

The suction fan 130 may be disposed vertical to an air flow direction in order to suction air, but in order to maximize the air suction amount in a limited space, is disposed by using the widest side edge space of the cabinet 10 in the space between the upper part of the tub 17 and the top cover 10*a*.

Since the compressor 113 also has a greater volume compared to other components of the heat pump and has a narrow space between the upper part of the tub 17 and the top cover 10*a* of the cabinet 10, a space between the upper outer circumference surface of the tub 17 and the side edge of the cabinet 10 may be utilized as an arrangement space of the compressor 113.

In order to compactly optimize the arrangement space of the compressor 113, the compressor 113 may be disposed at the upper part of the tub 17. The compressor base part 122 may be disposed in a side edge space of the cabinet 10. The compressor base part 122 may be disposed at the rear side surface of the heat exchange duct part 121. The compressor 113 may be a lateral compressor disposed to be laid down in the front and rear direction with respect to a horizontal reference surface.

The heat pump system is important not only to compactly optimize a complicated configuration but also to reduce the noise and vibration of the compressor 113. This is even more important when the compressor 113 is disposed at the upper part of the tub 17 as in the present disclosure.

A support structure of the compressor 113 will be described in more detail.

The compressor base part 122 has a structure that surrounds the both side surfaces and the bottom surface of the lateral compressor 113. When seen from the back cover 10*e*, the compressor base part 122 may have a U-shaped section opened upwardly. At this point, the bottom surface of the compressor base part 122 may be formed rounded along the upper surface of the tub 17 like the heat exchange duct part 121.

In order to minimize the vibration occurring from the compressor 113, the heat pump module 100 may include a bracket 1131 disposed at the upper surface of the compressor 113, an anti-vibration mount 1132 disposed between the bracket 1131 and the compressor base part 122, and a fastening bolt 1133 for fastening the anti-vibration mount 1132 and the compressor base part 122.

The bracket 1131 is welded to three places at the upper surface of a compressor casing. The bracket 1131 is fixed at the upper surface of the compressor casing in order to deliver the vibration occurring from the compressor 113 to the anti-vibration mount 1132. The middle portion of the bracket 1131 may be convex upwardly and rounded to be tightly fixed to the outer circumference surface of the compressor 113. The welding portion are fixed at three places of the round surface of the bracket 1131 that closely contacts the compressor casing, that is, two places toward a discharge port of the compressor 113 and one place at the rear thereof. A fixing hole 1131*a* is formed at each of four places of the edge parts of the bracket 1131. The fixing hole 1131*a* is a hole through which the fastening bolt 1133 penetrates.

The anti-vibration mount 1132 may be formed of a rubber material appropriate for absorbing vibration. The anti-vibration mount 1132 has a hollow part therein and has a wavy outer side surface. When vibration is delivered from the upper part of the anti-vibration mount 1132 in the up and down direction and the left and right/front and rear direction, the anti-vibration mount 1132 may absorb vibration. The anti-vibration mount 1132 may be disposed at four places to fit the fixing hole 1131*a* formed at the outer part of the bracket 1131.

Both side surfaces of the compressor base part 122 include a support 1221 formed parallel in a vertical upward direction to receive and surround both side surfaces of the compressor 113. An opening part is formed at the side lower part of the support 1221 and fastening bolt holes formed penetrating the opening part in a vertical upward direction at the lower part of the support 1221 are formed at two places, that is, in front of and behind the support 1221.

A fastening bolt 1133 may serve as a bolt. The lower end part of the fastening bolt 1133 may have a greater diameter than the fastening bolt 1133 like a bolt head and a screw part may be formed at the upper end part of the fastening bolt 1133. The fastening bolt 1133 may penetrate the fastening bolt hole of the support 1221, the anti-vibration mount 1132, and the fixing hole 1131*a* of the bracket 1131 and the screw part of the fastening bolt 1133 may be fastened to a nut. Due to this, the fastening bolt 1133 may fasten the bracket 1131, the anti-vibration mount 1132, and the support 1221 of the compressor base part 122.

By such a support structure of the compressor 113, the vibration occurring from the compressor 113 may be delivered to the anti-vibration mount 1132 through the bracket 1131 and the anti-vibration mount 1132 may absorb the vibration of the compressor 113.

Additionally, the lateral compressor 113 may be formed to be inclined at a predetermined angle with respect to a horizontal plane. This is to prevent the overheating or damage of the compressor 113 which may occur due to friction between compression apparatus parts configured in the compressor 113, for example, a rolling piston and a cylinder, during the relative movements thereof.

When looking into an internal configuration of the lateral compressor 113, an electrically-driven apparatus part configured including a stator and a rotor may be disposed in front of the compressor casing, and a compression apparatus part configured including a rolling piston, a cylinder, and a bearing may be disposed behind the compressor casing. The compressor 113 may be configured to serve as a lubricant as storing a predetermined amount of oil in the compressor casing and supplying the oil between the rolling piston and the cylinder, which have relative movements. However, when the compressor casing is disposed horizontally, oil may moves toward the front of the compressor casing so that oil at the compression apparatus part side may be insufficient. In this case, the compressor 113 may be overheated or damaged due to the lack of oil, and the operation of the compressor 113 may be stopped. To minimize these oil shortages, the rear of the compressor 113 is inclined to be lower than a horizontal plane, and the oil inside the compressor casing may be collected toward the compression apparatus part and sufficiently supplied to the compression apparatus part.

A power connection part and a discharge port for discharging a refrigerant may be formed at the front surface of the lateral compressor 113. The front surface of the compressor 113 is a surface close to the rear surface of the heat exchange duct part 121.

The discharge part of the compressor 113 may be formed at the front surface of the compressor casing and the suction port of the compressor 113 for suctioning a refrigerant may be formed at the lower part of the outer circumference surface of the compressor casing. This is to shorten the length of a refrigerant pipe connecting the suction port of the compressor 113 and the discharge port of the evaporator 111 and the length of a refrigerant pipe connecting the discharge port of the compressor 113 and the suction port of the condenser 112.

Additionally, a gas-liquid separator 115 may be installed at a refrigerant pipe connecting the evaporator 111 and the compressor 113. The gas-liquid separator 115 separates a liquid refrigerant from a gas refrigerant by the difference in specific gravity and the separated liquid refrigerant is stored in the gas-liquid separator 115 and only the gas refrigerant is moved to the compressor 113. The gas-liquid separator 115 may be mounted on a gas-liquid separator mounting part 123 integrally provided between the rear of the heat exchange duct part 121 and the left side surface of the compressor base part 122.

The heat pump module 100 circulates two types of fluids, that is, air and refrigerant, through separate flow passages and allows the air and refrigerant to exchange heat through the evaporator 111, thereby removing moisture in the air, and allows the air and refrigerant to exchange heat through the condenser 112, thereby heating the air.

The heat pump module 100 includes the compressor 113, the condenser 112, the expansion valve 114, and the evaporator 111. When looking into the movement path of the refrigerant, the refrigerant circulates in the order of the compressor 113, the condenser 112, the expansion valve 114, and the evaporator 111, which are connected through refrigerant pipes.

The compressor 113 compresses the gas refrigerant to a high temperature and a high pressure and applies a circulating power to the refrigerant. The refrigerant compressed in the compressor 113 moves to the condenser 112, and as the refrigerant is condensed from a gas phase to a liquid phase in the condenser 112, it exchanges heat with the air flowing through the condenser 112 and as condensation latent heat is delivered through air, the air is heated. As the condensed refrigerant passes through the expansion valve 114, the high-temperature and high-pressure refrigerant in a liquid phase is decompressed to a pressure in which the refrigerant evaporates by the throttling action of the expansion valve 114 and becomes a low-temperature and low-pressure refrigerant in a liquid phase. The decompressed low-temperature and low-pressure liquid refrigerant is moved to the evaporator 111. The refrigerant in the evaporator 111 exchanges heat with the air passing through the evaporator 111 to absorb heat from the air and evaporates from a liquid phase to a gas phase.

When looking into the movement path of air, the air is discharged from the drum 18 and moved to the evaporator 111 and then, exchanges heat with the refrigerant in the evaporator 111 to give off the heat to the refrigerant. Therefore, moisture in the air is condensed and removed from the air and then, the condensed water descends to the bottom surface of the evaporator 111 and is drained. Then, the moisture-removed air moves directly to the condenser 112, and the refrigerant and air are heat-exchanged in the condenser 112, so that the heat of the refrigerant is discharged to the air, and the air is heated. The heated air is withdrawn from the condenser 112 and re-supplied into the drum 18 through the air inlet of the tub 17 again.

Figure 6A:
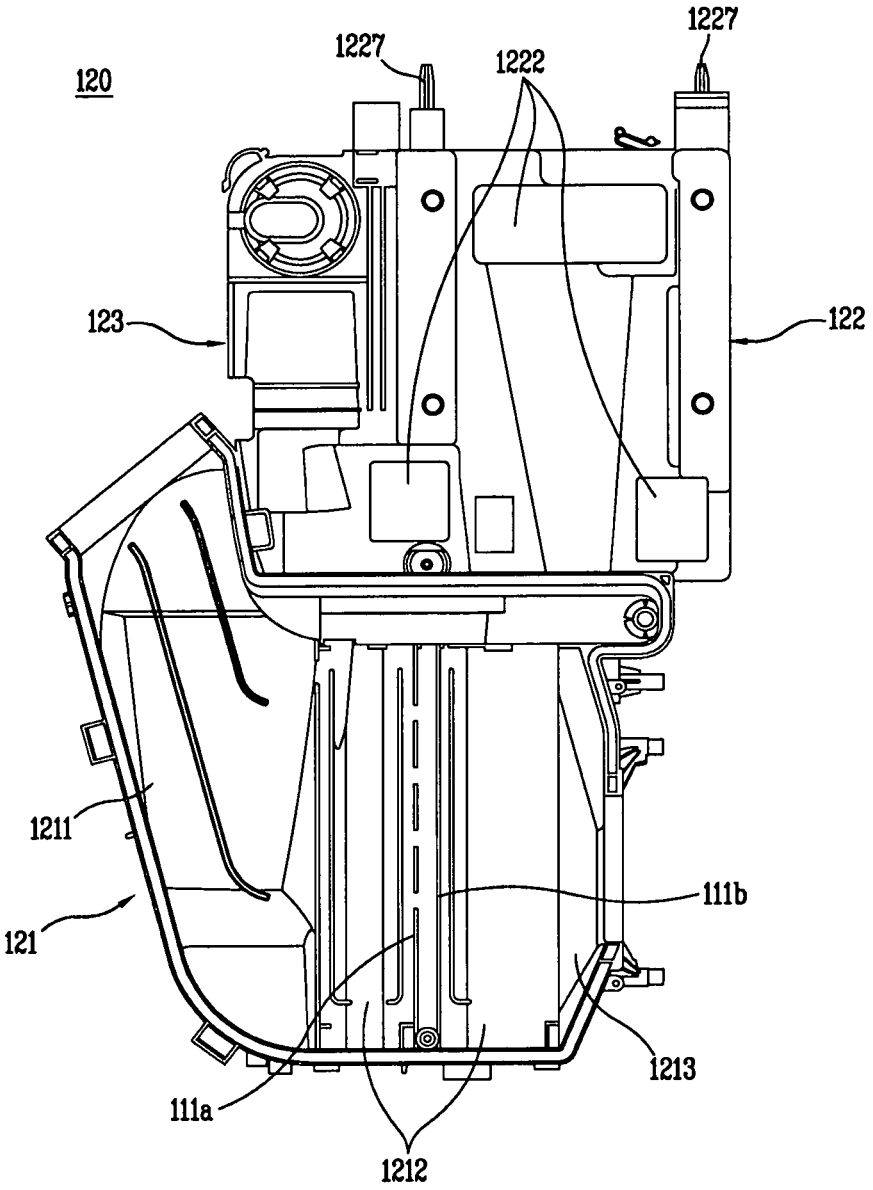
FIG. 6A is a plan view of an integrated housing of FIG. 5.
Figure 6B:
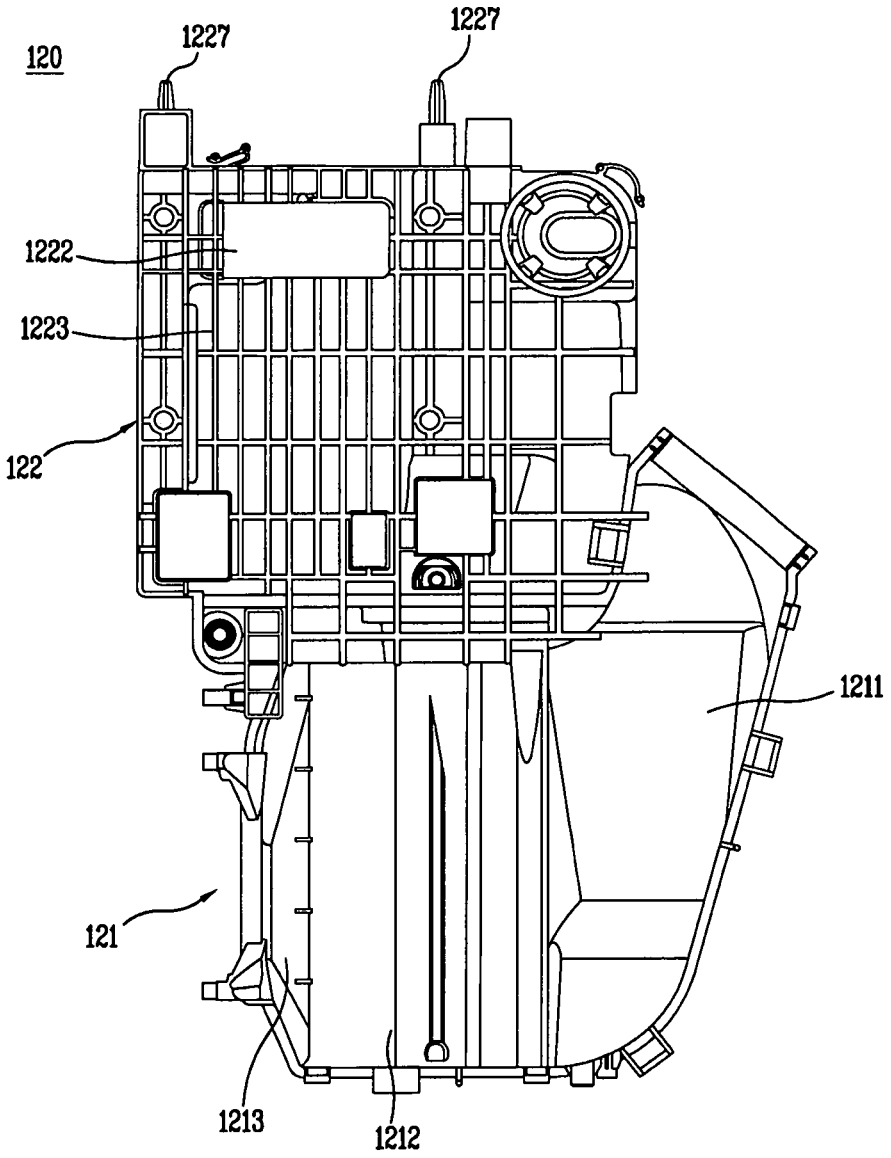
FIG. 6*b* is a bottom view of an integrated housing of FIG. 5.

FIG. 6A is a plan view of an integrated housing of FIG. 5 and FIG. 6B is a bottom view of an integrated housing of FIG. 5.

Referring to FIG. 6A, an integrated housing 120 may largely be configured to include a heat exchange duct part 121 and a compressor base part 122. The heat exchange duct part 121 is located at the lower side of the plan view and the compressor base part 122 is located at the upper side of the plan view. In the plan view, the lower side is the side of the front cover 10*d* of the cabinet 10 and the upper side is the side of the back cover 10*e* of the cabinet 10. The heat exchange duct part 121 and the compressor base part 122 may be disposed to be biased from the rotation center line 181 of the drum 18 toward the right side cover 10*b*. The first connection duct 1211 of the heat exchange duct part 121 may be disposed adjacent to the rotation center line 181 of the drum 18. The second connection duct 1213 of the heat exchange duct part 121 and the compressor base part 122 may be disposed close to the right side cover 10*b*. A gas-liquid separator mounting part 123 may be disposed between the right side surface of the first connection duct 1211 and the left side surface of the compressor base part 122.

A plurality of rectangular holes 1222 may be formed at the bottom front and rear of the compressor base part 122 in order to avoid interference with other components. For example, since the expansion valve 114 is disposed at a refrigerant pipe connecting the condenser 112 and the evaporator 111 but disposed outside the heat exchange duct part 121, an interference between pipes such as a refrigerant pipe connected to the expansion valve 114 and a refrigerant pipe connected to the refrigerant suction port of the compressor 113 and the bottom surface of the compressor base part 122 may be avoided by the rectangular holes 1222.

The heat exchange duct part 121, the compressor base part 122, and the gas-liquid separator 115 may be connected as one body and formed integrally. Moreover, reinforcing ribs 1223 may be formed at the bottom surface of the compressor base part 122 shown in FIG. 6B in a lateral direction and a longitudinal direction, e.g., in a lattice shape.

Figure 7A:
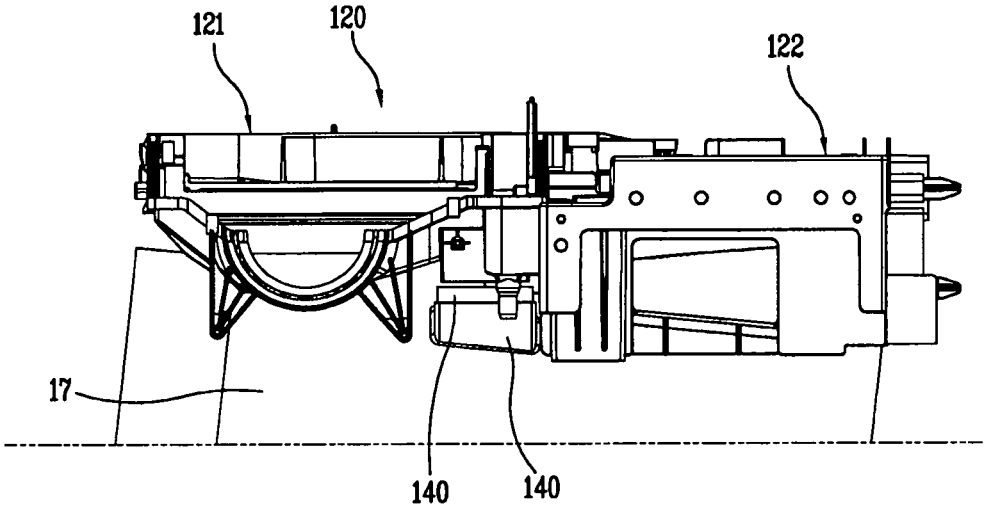
FIG. 7A is a side view of an integrated housing of FIG. 6A viewed from the right side cover.
Figure 7B:
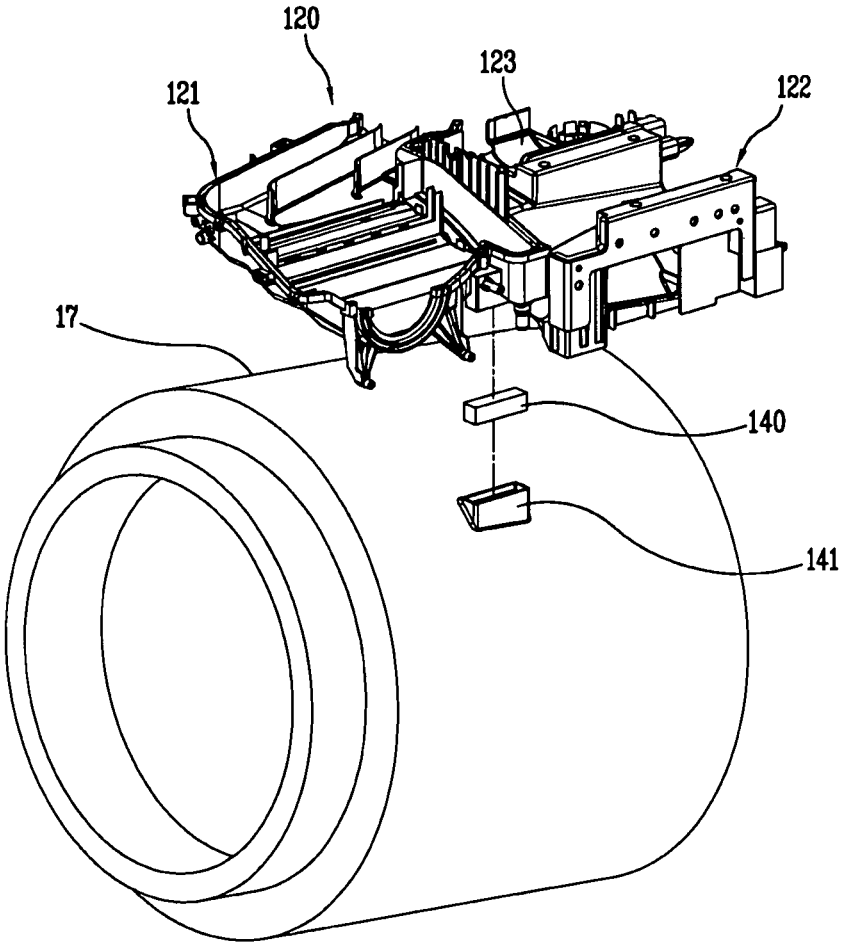
FIG. 7B is an exploded perspective view illustrating installation of a buffer member of FIG. 7A at the upper outer circumference surface of a tub.

FIG. 7A is a side view of the integrated housing of FIG. 6A when seen from a right side cover, and FIG. 7B is an exploded perspective view of a buffer member of FIG. 7A installed at the upper outer circumference surface of a tub.

The integrated housing 120 shown in FIG. 7A may be disposed at the upper part of the tub 17 with an interval, e.g., spaced from the tub 17. A buffer member coupling part 141 for fixing the buffer member 140 may be provided to protrude at the outer circumference upper part of the tub 17. The buffer member coupling part 141 may include an insertion groove therein and the lower part of the buffer member 140 may be inserted into the insertion groove and supported therein. The buffer member 140 may be a rubber material or another appropriate type of material sufficient for alleviating impact and the form of the buffer member 140 is not specifically limited.

The buffer member 140 may normally maintain an interval or gap at a prescribed distance with respect to the bottom surface of the integrated housing 120. When the integrated housing 120 sags or otherwise moves downward, the buffer member 140 absorbs the impact transmitted from the integrated housing 120. When the sagging of the integrated housing 120 occurs, a portion of the bottom surface of the integrated housing 120 may be formed in a plane as facing the upper surface of the buffer member 140 in order to contact the buffer member 140. A portion of the integrated housing 120 contacting the buffer member 140 may be disposed at or disposed close to the center of gravity of the integrated housing 120.

The buffer member 140 may be disposed close to the right side cover 10*b* along the outer circumferential surface from the upper center part of the tub 17. If the buffer member 140 is disposed at the upper center part of the tub 17, the entire load of the heat pump module 100 may be transmitted to the tub 17 through the integrated housing 120. Due to this, the upper center part of the tub 17 may experience a downward impact and crushed. However, if the buffer member 140 is fixed to be biased in a side direction along the outer circumference surface from the upper center part of the tub 17, the direction of the transmitted force (e.g., impact force) is in the direction of gravity and the force in the direction of gravity may dispersed in the circumferential direction along the outer circumference surface of the tub 17 to effectively absorb the impact.

Figure 8A:
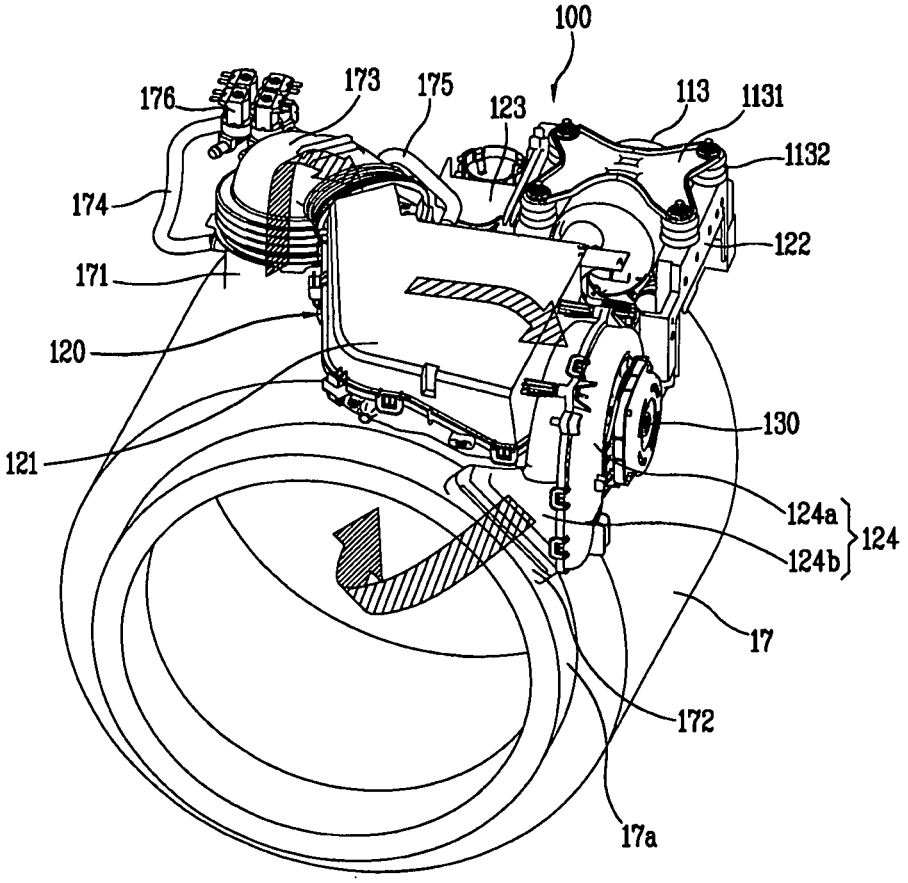
FIG. 8A is a perspective view illustrating a heat pump module according to the present disclosure mounted at the upper part of a tub.
Figure 8B:
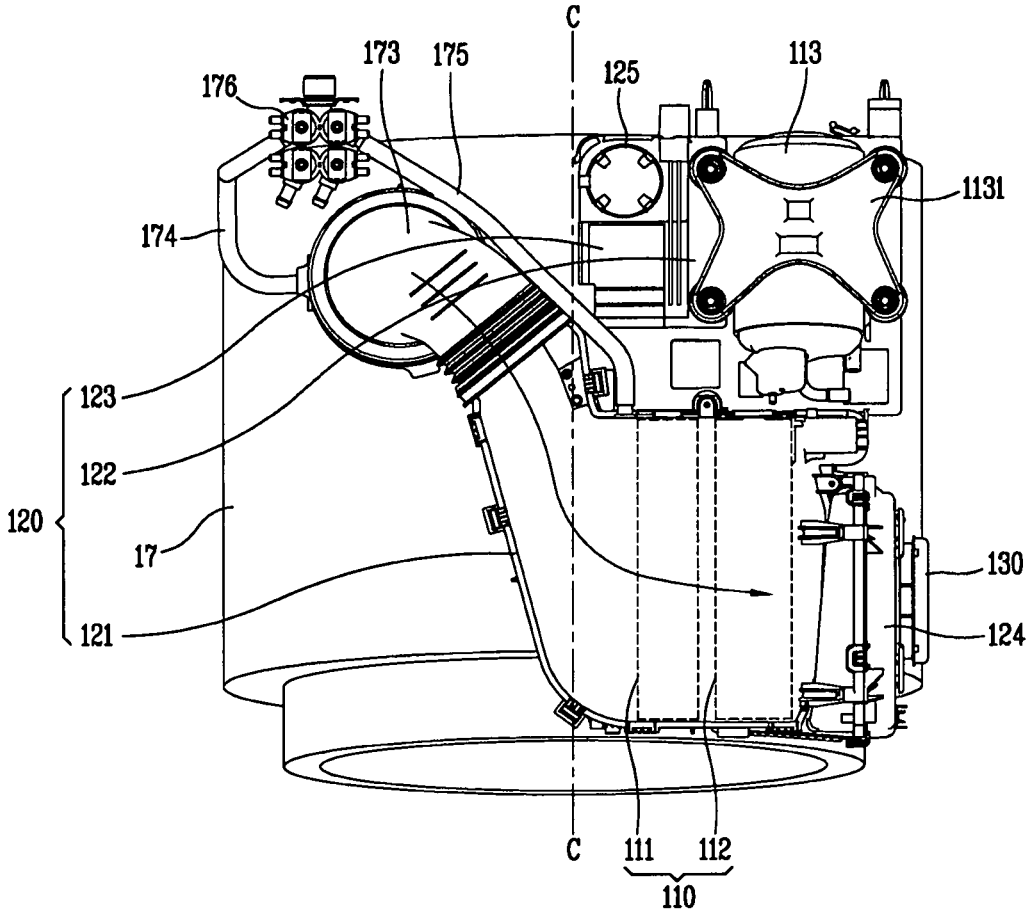
FIG. 8B is a plan view of the heat pump module and tub of FIG. 8A.
Figure 8C:
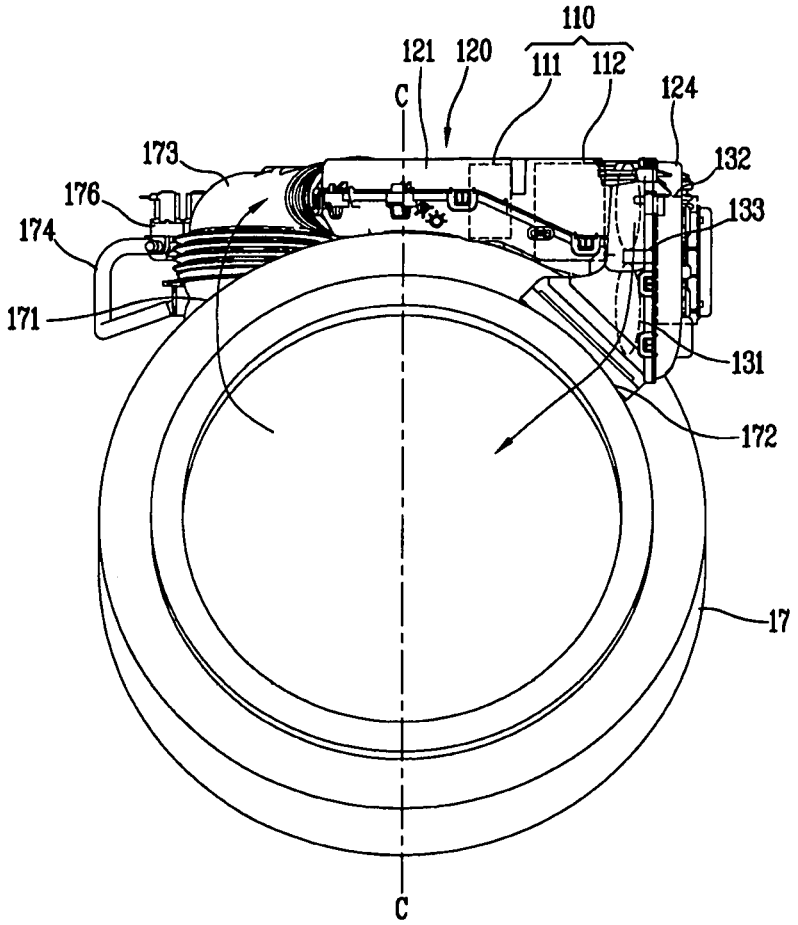
FIG. 8C is a front view of the heat pump module and tub FIG. 8A.
Figure 8D:
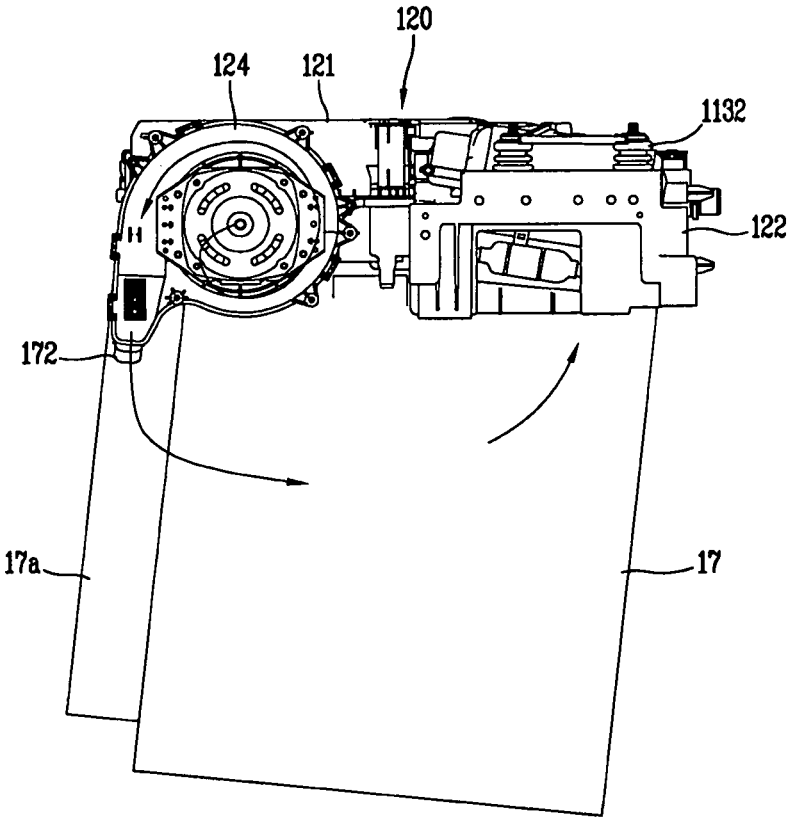
FIG. 8D is a side view of the heat pump module and tub FIG. 8A.

Hereinafter, the entire arrangement and configuration of the heat pump module 100 according to the present disclosure will be described with reference to FIGS. 8A to 8D. FIG. 8A is a perspective view of a heat pump module mounted at the upper part of a tub. FIG. 8B is a plan view of FIG. 8B. FIG. 8C is a front view of a cabinet of FIG. 8A. FIG. 8D is a right side view of the cabinet of FIG. 8A.

Referring to FIG. 8A, a heat pump module 100 may include an integrated housing 120 to be compactly disposed at the upper part of the tub 17. The integrated housing 120 may include a heat exchange duct part 121 and a fan duct part 124 disposed at the front of the tub 17, and a compressor base part 122 and a gas-liquid separator mounting part 123 disposed at the rear of the tub 17.

The heat exchange duct part 121 may receive and support the evaporator 111 and the condenser 112 therein. Additionally, the heat exchange duct part 121 may be connected to the tub 17 to form a circulation flow passage for air in order to re-circulate the air discharged from the tub 17 to the tub 17 again.

The fan duct part 124 may include a suction fan 130 therein and may be vertically disposed at the right side surface of the heat exchange duct part 121. The fan duct part 124 may be detachably coupled to the heat exchange duct part 121 in an integral shape. The suction fan 130 may be configured to include an impeller 131 and a fan motor 132 for driving the impeller 131.

The compressor base part 122 may support a main body of the compressor 113 and may be installed such that the main body of the compressor 113 is hung at the upper part of the compressor base part 122 by using a bracket 1131 and an anti-vibration mount 1132. Thus, it is possible to reduce transmission of vibration from the lateral compressor 113. Additionally, the main body of the compressor 113 may be received in the compressor base part 122 and surrounded by the compressor base part 122. Moreover, the gas-liquid separator mounting part 123 may be provided to mount the gas-liquid separator 115. The heat exchange duct part 121, the fan duct part 124, the compressor base part 122, and the gas-liquid separator mounting part 123 may all be configured as one body.

The tub 17 may include an air outlet 171. Referring to FIGS. 8A and 8B, the air outlet may form to be biased to the left side from the upper center rear end part relative to a center line C-C. The heat exchange duct part 121 may be connected to the air outlet 171 of the tub 17 by the tub connection duct 173. A first water supply hose 174 may be connected to a portion connecting the tub 17 and the tub connection duct 173. The first water supply hose 174 may be connected to a water supply valve 176 and may supply washing water provided from a water supply source through the air outlet 171. A second water supply hose 175 may be connected to the rear surface of the duct cover of the heat exchange duct part 121. The second water supply hose 175 is a hose for supplying washing water to the spray surface of the evaporator 111.

One end of the tub connection duct 173 is connected to the air outlet 171 of the tub 17 and the other end of the tub connection duct 173 is connected to the suction port of the heat exchange duct part 121. An anti-vibration member formed of a rubber material or the like having a bellows shape may be inserted for installation between the other end part of the tub connection duct 173 and the suction port of the heat exchange duct part 121. Hence, the vibration generated from the tub 17 may be insulated and prevent transfer of vibration to the heat exchange duct part 121.

Referring to FIG. 8A again, a gasket 17*a* of a rubber material or the like may be formed at the front end part of the tub 17 and an air inlet 172 may be formed at the right upper part of the gasket 17*a*.

The suction fan 130 may be disposed vertically at the right side surface of the heat exchange duct part 121. The suction fan 130 may suction the air discharged from the tub 17 into the tub connection duct 173 and the heat exchange duct part 121. Additionally, the suction fan 130 may force the suctioned air back into the tub 17.

In relation to the fan duct part 124, the rotation axis of the suction fan 130 may be disposed to face the right side surface of the heat exchange duct part 121 and the right side cover of the cabinet such that the impeller 131 rotates around on the rotation axis 133.

The fan duct part 124 may include a fan housing 124*a* in a ring form that surrounds the impeller 131 and a discharge part 124*b* that extends in a left diagonal direction from the front side lower part of the fan housing 124*a* to be connected to the gasket 17*a* of the tub 17. The discharge part 124*b* has a sectional area that largely extends wider as it progressively goes from the front side surface of the fan housing 124*a* toward the air inlet 172 of the tub 17. Herein, the discharge direction of air in the discharge part 124*b* is a direction that goes from the right upper part of the tub 17 toward the left lower part. This is to improve the drying performance by ensuring the widest contact area between air and laundry. Additionally, the discharge pressure of air discharged from the fan duct part 124 may be determined by blowing air in a radial direction from the center part of the fan housing 124*a* through centrifugal force caused by the rotation of the impeller 131. Additionally, as the number of revolutions of the impeller 131 increases, the discharge flow rate of the air may increase (see FIGS. 8A and 8D).

Referring to FIG. 8B, the air discharged from the tub 17 passes through the heat exchange duct part 121 through the tub connection duct 173, and moves in a diagonal direction from the upper left of the tub 17 toward the upper right of the tub 17. The compressor base part 122 may be disposed at the upper right rear of the tub 17. Herein, the rear of the tub 17 is the upper side and the front of the tub 17 is the rear side in the drawing.

The gas-liquid separator mounting part 123 may be close to the center line C-C of the tub 17 and may be disposed at the upper center rear of the tub 17. The gas-liquid separator 115 according to the present disclosure may be provided as a component separated from the compressor 113.

The reason for separating the gas-liquid separator 115 from the compressor 113 is that since the gas-liquid separator 115 of the heat pump module 100 applied to a garment processing apparatus generally has a small capacitance, due to conditions of the outside environment such as winter when the temperature drops below freezing, the flow rate of a liquid refrigerant that has not been completely vaporized in the evaporator 111 may be large. Accordingly, in order to increase the capacity of the gas-liquid separator 115, it is desirable that the gas-liquid separator 115 is provided not as a part of the compressor 113 but as a separate independent component. Additionally, a diameter of the gas-liquid separator 115 according to the present disclosure is preferably about ⅓ to about ¾ of the diameter of the compressor 113.

The gas-liquid separator 115 may be mounted on the gas-liquid separator mounting part 123 and supported and the gas-liquid separator mounting part 123 may be integrally formed at the left side surface of the compressor base part 122 and the rear side surface of the heat exchange duct part 121. However, the gas-liquid separator 115 may be disposed apart from the main body of the compressor 113. Additionally, a pressure switch mounting part 125 for mounting a pressure switch at the rear of the gas-liquid separator 115 may be further included.

Referring to FIGS. 8B and 8C, the evaporator 111 and the condenser 112 are received in the heat exchange duct part 121, and may be disposed to be biased from the center line C-C of the tub 17 toward the right side and disposed spaced apart from each other in a direction intersecting the center line C-C of the tub 17.

Referring to FIG. 8C, the heat exchange duct part 121 may have a sectional area that is gradually increased as it progressively goes from the center line C-C of the tub 17 toward the right side. The upper surface of the heat exchange duct part 121 may be a plane to be parallel to the top cover of the cabinet and the lower surface of the heat exchange duct part 121 may extend downwardly to utilize the upper space of the tub 17 to the maximum effect by facing the upper outer circumference surface of the tub 17.

The upper surface of the heat exchange duct part 121, the upper surface of the evaporator 111, and the upper surface of the condenser 112 may be disposed on substantially the same plane. For example, a height difference between these upper surfaces may be within about 1 cm. However, the lower end part of the evaporator 111 may extend lower in a downward direction than the bottom surface at the suction side of the heat exchange duct part 121, and the lower end part of the condenser 112 may extend lower in a downward direction than the lower end part of the evaporator 111, so that a heat exchange area may be increased. Accordingly, the performance of the heat pump may be improved by increasing the sizes of the evaporator 111 and the condenser 112 in order to increase the heat exchange area.

According to the present disclosure constituted by the solution means described above, there are the following effects.

First, a heat exchanger, a compressor, a suction fan, and the like may be integrally modularized and mounted at the upper part of a tub, thereby compactly optimizing the arrangement space of a heat pump system, and further contributing to the miniaturization of a garment processing apparatus.

Second, as a heat pump system is modularized as one body, the installation and assembly of the heat pump system is simplified.

Third, the performance of a heat pump may be tested as a module unit before a garment processing apparatus is assembled as a finished product.

Fourth, the length of a refrigerant pipe connecting a compressor and a heat exchanger may be shortened, thereby reducing energy losses.

Fifth, as a compressor is disposed in a lateral shape or orientation, issues related to narrow installation space available for a compressor may be solved.

Sixth, as the air inlet of a tub connected to a heat exchange duct part is formed at a gasket, the degradation of the rigidity of the tub may be prevented.

Seventh, although a gas-liquid separator is constituted as a part of a compressor in a conventional device, a gas-liquid separator according to the present disclosure is provided separately from the compressor, and the capacity of the gas-liquid separator may be larger than that of existing gas-liquid separators. Hence, it is possible to secure sufficient storage space for liquid refrigerant that is not vaporized even in cold weather where a temperature falls below minus zero.

Therefore, an aspect of the detailed description is to provide a garment processing apparatus including a heat pump module that optimizes an arrangement space of a heat pump system.

Another aspect of the detailed description is to provide a garment processing apparatus including a heat pump module for easy assembly of a heat pump system.

Another aspect of the detailed description is to provide a garment processing apparatus including a heat pump module for testing the performance of a heat pump system by a module unit.

Another aspect of the detailed description is to provide a garment processing apparatus for saving energy by reducing a pipe length between a heat exchanger such as an evaporator, a condenser, and the like and a compressor in a heat pump system.

Another aspect of the detailed description is to provide a garment processing apparatus in which the installation of a compressor is possible even when a space between a tub upper part and a cabinet is narrow.

Another aspect of the detailed description is to provide a garment processing apparatus for reducing the number of holes connected to a heat exchanger duct.

Another aspect of the detailed description is to provide a garment processing apparatus for optimizing a heat pump module in a cabinet compactly through modulation by an integrated housing where an evaporator, a condenser, a compressor, and an expansion valve are integrally received.

Another aspect of the detailed description is to provide a heat pump module that integrally modularizes a heat exchange duct part that receives an evaporator and a condenser and a compressor base part that supports a compressor is mounted at the upper part of a tub once.

Another aspect of the detailed description is to provide a lateral compressor in which a rotation axis is disposed to be laid down toward the front and rear direction of a cabinet is provided.

Another aspect of the detailed description is to provide a part of a heat exchange duct part connected to communicate with a tub is connected to a gasket of a rubber material.

To achieve these and other advantages and in accordance with the purpose of this specification, as embodied and broadly described herein, there is provided a garment processing apparatus which may include: a cabinet; a tub provided inside the cabinet; a drum rotatably provided in the tub and providing a reception space for washing and drying laundry; and a heat pump module configured to circulate a refrigerant to a compressor, a condenser, an expansion valve, and an evaporator and re-circulate air discharged from the drum to the drum through the evaporator and the condenser. The heat pump module may include an integrated housing configured to mount the compressor, the condenser, and the evaporator integrally, disposed at an upper part of the tub, and supported by a plurality of fastening members at a front surface and a rear surface of the cabinet.

A plurality of fastening parts protruding in a pipe shape may be provided at a front surface and a rear surface of the integrated housing and the plurality of fastening members may be inserted into and screw-fastened to the plurality of fastening parts.

The integrated housing may include: a heat exchange duct part configured to receive the evaporator and the condenser and connected to the tub to form a flow passage for circulating air discharged from the tub; and a compressor base part configured to be formed integrally with the heat exchange duct part and support the compressor. The plurality of fastening members may fasten a front surface of the heat exchange duct part to a front surface of the cabinet and fasten a rear surface of the compressor base part to a rear surface of the cabinet.

The plurality of fastening parts may be formed on at least two places at each of a front surface of the heat exchange part and a rear surface of the compressor base part.

The garment processing apparatus may further include: a first reinforcing rib configured to surround an outer circumference surface of the fastening part and disposed spaced while facing the outer circumference surface of the fastening part; and a plurality of reinforcing ribs configured to protrude along a circumferential direction from the outer circumference surface of the fastening part toward the reinforcing part.

The garment processing apparatus may further include a reinforcing rib configured to protrude along a circumferential direction from an outer circumference surface of the fastening part to contact each of a front surface or a rear surface of the integrated housing.

The garment processing apparatus may further include a second reinforcing part configured to protrude from a front surface or a rear surface of the integrated housing to surround an outer circumference surface of the fastening part and allow at least one inner side surface to contact the fasting part.

The garment processing apparatus may further include a protruding part configured to protrude to be disposed spaced from the fastening part at a front surface and a rear surface of the integrated housing. A guide hole where the protruding part is inserted may be formed at each of the front surface and the rear surface of the cabinet.

There is also provided a garment processing apparatus which may include: a cabinet; a tub provided inside the cabinet; a drum rotatably provided in the tub and providing a reception space for washing and drying laundry; and a heat pump module configured to circulate a refrigerant to a compressor, a condenser, an expansion valve, and an evaporator and re-circulate air discharged from the drum to the drum through the evaporator and the condenser. The heat pump module may integrate the evaporator, the condenser, and the compressor by an integrated housing; and the integrated housing may include: a heat exchange duct part configured to receive the evaporator and the condenser and connected to the tub to form a circulation flow passage of the air; and a compressor base part configured to be integrally formed with a rear side surface of the heat exchange duct part and support the compressor.

The integrated housing may be mounted at an upper part of the tub.

A suction port of the heat exchange duct part may extend from a center line of the tub toward a left rear when seen from the upper part of the cabinet and a discharge port of the heat exchange duct part may extend toward a right front.

A fan duct part may be integrally fastened to a side surface of the discharge port of the heat exchange duct part; and the fan duct part may include a suction fan inside to suction air discharged from the tub.

The suction fan may be disposed between side covers for forming a right side surface of the heat exchange duct part and a right side surface of the cabinet to allow a rotation axis connecting an impeller and a fan motor to face the discharge port of the heat exchange duct part.

The suction port of the heat exchange duct part may be connected to an air outlet of the tub formed to be biased from a center line rear of the tub to the right through a tub connection duct and the discharge port of the heat exchange duct part may be connected to an air inlet of the tub formed to be biased from a center line front of the tub toward the right through a fan duct part.

The air inlet of the tub may be formed at a right upper surface of a gasket provided at a front surface of the tub.

The evaporator and the condenser may be disposed spaced apart from each other from a center line of the tub toward a right side direction when seen from the front of the cabinet.

The evaporator and the condenser may be disposed spaced apart from each other in a direction intersecting the center line of the tub when seen from the upper part of the cabinet.

The evaporator may extend lower than an upper center part of the tub from an upper surface of the heat exchange duct part when seen from the front of the cabinet; the condenser may extend lower than a lower end part of the evaporator from the upper surface of the heat exchange duct part; and the condenser may have a greater heat exchange area than the evaporator.

There is also provided a garment processing apparatus including: a cabinet; a tub provided inside the cabinet; a drum rotatably provided in the tub and providing a reception space for washing and drying laundry; and a heat pump module configured to circulate a refrigerant to a compressor, a condenser, an expansion valve, and an evaporator and re-circulate air discharged from the drum to the drum through the evaporator and the condenser, further including a gas-liquid separator provided separated from the compressor.

The heat pump module may include an integrated housing configured to integrate the evaporator, the condenser, the compressor, the expansion valve, and the gas-liquid separator.

The integrated housing may include: a heat exchange duct part configured to receive the evaporator and the condenser and connected to the tub to form a circulation flow passage of the air; a compressor base part configured to be, integrally formed with a rear side surface of the heat exchange duct part and support the compressor; and a gas-liquid separator mounting part configured to be integrally formed of a rear side surface of the heat exchange duct part and one side surface of the compressor base part and mount the gas-liquid separator.

The compressor base part may surround and support an outer circumference surface of the compressor.

The heat exchange duct part may include a duct body and a duct cover coupled detachably to an upper part and a lower part.

The heat exchange duct part may be disposed at an upper part of the tub; and the compressor base part may be disposed in a space between an upper rear of the tub and a side edge of the cabinet.

The compressor may be a lateral compressor including a rotation axis inside, wherein both end parts of the rotation axis may be disposed in a lateral direction to face a front surface and a rear surface of the cabinet.

The lateral compressor may be received in the compressor base part and may support a compressor body in a form of hanging at an upper surface of the compressor base part by using a bracket and an anti-vibration mount disposed at an upper surface of the compressor base part.

The integrated housing may be disposed in a space between an upper part of the tub and a side edge of the cabinet.

A buffer member may be provided at an upper outer circumference surface of the tub and when there is a sagging in the heat pump module, the integrated housing and the buffer member may contact each other to alleviate impact.

The tub may be installed to be inclined at an angle greater than 0 degree and less than 10 degrees to allow a front part to be located higher than a rear part.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A garment processing apparatus comprising:

a cabinet;

a tub provided inside the cabinet;

a drum rotatably provided in the tub and providing a reception space to receive laundry; and a heat pump module configured to circulate a refrigerant among a compressor, a condenser, an expansion valve, and an evaporator and to re-circulate air discharged from the drum to the drum through the evaporator and the condenser, wherein the heat pump module integrates the evaporator, the condenser, and the compressor in an integrated housing, wherein the integrated housing includes:

a heat exchange duct part that houses the evaporator and the condenser and is connected to the tub to form a circulation flow passage for air; and a compressor base part which is formed integrally with the heat exchange duct part and is configured to support the compressor, wherein the compressor is a lateral compressor having a rotation axis within a compressor body, wherein a bracket is coupled to and extends from the compressor body, wherein the bracket is coupled to the compressor base part such that the compressor is suspended above the compressor base part and is positioned to be inclined with respect to a horizontal surface so that a rear portion of the compressor is lower than a front portion of the compressor, and wherein the compressor base part includes at least one support that extends vertically to form a convex region to receive the compressor, and the bracket is coupled to the at least one support.

2. The garment processing apparatus of claim 1, wherein the integrated housing is mounted at an upper part of the tub.

3. The garment processing apparatus of claim 2, wherein a suction port of the heat exchange duct part is provided left of a center line of the tub at a left rear portion of the cabinet, and a discharge port of the heat exchange duct part is provided right of the center line of the tub at a right front portion of the cabinet.

4. The garment processing apparatus of claim 3, wherein a fan duct part is fastened to a side surface of the discharge port of the heat exchange duct part, and wherein a suction fan is provided inside the fan duct part to suction air discharged from the tub.

5. The garment processing apparatus of claim 4, wherein the suction fan is disposed between a side cover that forms a right side surface of the heat exchange duct part and a right side surface of the cabinet to allow a rotation axis of an impeller and a fan motor to extend in a lateral direction toward the right side surface of the cabinet.

6. The garment processing apparatus of claim 4, wherein the suction port of the heat exchange duct part is connected to an air outlet of the tub that is provided at a rear of the tub, left of a center line of the tub and extending to the right through a tub connection duct, and the discharge port of the heat exchange duct part is connected to an air inlet of the tub that is provided at a front of the tub, right of the center line of the tub through a fan duct part.

7. The garment processing apparatus of claim 6, wherein the air inlet of the tub is formed at a right upper surface of a gasket provided at a front surface of the tub.

8. The garment processing apparatus of claim 2, wherein the evaporator and the condenser are disposed right of a center line of the tub in an upper portion of the cabinet.

9. The garment processing apparatus of claim 8, wherein the evaporator and the condenser are disposed to be spaced apart from each other in the heat exchange duct part such that air flows in a direction from a left side of the cabinet to a right side of the cabinet.

10. The garment processing apparatus of claim 8, wherein the evaporator is provided to extend lower than an upper center part of the tub from an upper surface of the heat exchange duct part, and the condenser extends lower than a lower end of the evaporator from the upper surface of the heat exchange duct part such that the condenser has a larger heat exchange area than the evaporator.

11. The garment processing apparatus of claim 1, wherein the compressor includes a discharge port to output the refrigerant, the discharge port being positioned at a front end of the compressor.

12. The garment processing apparatus of claim 11, further comprising a refrigerant pipe to carry the refrigerant between the discharge port of the compressor and the condenser.

13. The garment processing apparatus of claim 11, wherein the compressor includes a suction port to receive the refrigerant, and the suction port is positioned at a lower surface of the compressor.

14. The garment processing apparatus of claim 13, further comprising a refrigerant pipe to carry the refrigerant between the suction port of the compressor and the evaporator.

15. The garment processing apparatus of claim 1, wherein the compressor includes:

a compressor casing in which oil is stored;

an electrically-driven apparatus part provided at a front portion of the compressor casing and including a stator and a rotor; and a compression apparatus part disposed at a rear portion of the compressor casing and including a rolling piston and a cylinder that move relative to each other, wherein the oil is supplied between the rolling piston and the cylinder.

16. The garment processing apparatus of claim 1, further comprising at least one anti-vibration mount provided between the bracket and the support.

* * * * *